US009164456B2

(12) United States Patent
Koyama

(10) Patent No.: US 9,164,456 B2
(45) Date of Patent: Oct. 20, 2015

(54) IMAGE FORMING APPARATUS

(71) Applicant: CANON KABUSHIKI KAISHA, Tokyo (JP)

(72) Inventor: Shoichi Koyama, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/300,134

(22) Filed: Jun. 9, 2014

(65) Prior Publication Data

US 2014/0376932 A1 Dec. 25, 2014

(30) Foreign Application Priority Data

Jun. 20, 2013 (JP) ..... 2013-129813

(51) Int. Cl.
*G03G 15/00* (2006.01)
*G03G 15/23* (2006.01)

(52) U.S. Cl.
CPC ..... *G03G 15/5062* (2013.01); *G03G 15/234* (2013.01)

(58) Field of Classification Search
CPC ..... G03G 15/5058
See application file for complete search history.

(56) References Cited

U.S. PATENT DOCUMENTS

| | | | | |
|---|---|---|---|---|
| 5,925,889 | A | 7/1999 | Guillory et al. | |
| 7,239,427 | B2 * | 7/2007 | Tezuka et al. | 358/2.1 |
| 2003/0169345 | A1 * | 9/2003 | Rykowski et al. | 348/207.99 |
| 2008/0024827 | A1 * | 1/2008 | Kokubo | 358/3.26 |

FOREIGN PATENT DOCUMENTS

| | | | |
|---|---|---|---|
| JP | 11-216938 | A | 8/1999 |
| JP | 2003-149903 | A | 5/2003 |
| JP | 2004-085376 | A | 3/2004 |
| JP | 2006-214968 | A | 8/2006 |

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

The image forming apparatus includes an image forming section that forms a patch image T on a recording material P, a fixing unit that fixes the patch image, a spectral color measurement device that irradiates light onto the patch image T that was fixed by the fixing unit, and measures reflected light from the patch image, a white reference plate disposed facing the spectral color measurement device; and a control unit that controls a density or a chromaticity of an image based on a result obtained by measuring the patch image and a result obtained by measuring the white reference plate by means of the spectral color measurement device. It is thereby possible to improve the color measurement accuracy of a color measurement device.

14 Claims, 23 Drawing Sheets

IMAGE FORMING APPARATUS

BACKGROUND OF THE INVENTION

1. Field of the Invention

The present invention relates to an image forming apparatus that employs the inkjet system or the electrophotographic system or the like as an output device such as an image recording apparatus that has the functions of a copier and a printer or a multifunction machine or workstation having a combination of the aforementioned functions. In particular, the present invention relates to a method for measuring the color of an image.

2. Description of the Related Art

In recent years, there is a demand for color image forming apparatuses such as color printers and color copiers to enhance the image quality of an output image. In particular, the stability of the image gradation or the image color significantly influences the quality of an image. However, in the case of color image forming apparatuses, the tints of obtained images vary in some cases due to environmental changes such as in the temperature or humidity, lot differences that are due to residual quantities or substitution of consumables or the like, the media that is used (the kind of recording material), and use of the apparatus over an extended time period. Therefore, to realize stable tints in output images, it is effective to detect the tints of output images using a color measurement device, and to feed back the detected result to the process conditions of the image forming apparatus. A color measurement device measures the tint (chromaticity) of a printed material or of the color of an object. Available color measurement devices include, for example, a tristimulus value direct-reading type color measurement device which irradiates white light at a color measurement object, and receives the reflected light with a light-receiving sensor through RGB color filters to thereby measure the intensity of each color component. The following spectral color measurement device is also available. That is, a spectral color measurement device is known which disperses the wavelengths of the reflected light using a diffraction grating or a prism, and thereafter detects the intensity of each wavelength with a line sensor. Next, the spectral color measurement device determines the spectral reflectivity of the color measurement object by performing a calculation that takes into account the wavelength distribution of the dispersed light that was detected, the wavelength distribution of the light of a light source, and the spectral sensitivity of the sensor.

This kind of spectral color measurement device has a configuration as illustrated, for example, in FIG. 10A. A detailed description of FIG. 10A is provided later. Using this kind of spectral color measurement device, a reference sample for which the chromaticity or spectral reflectivity is known is measured in advance, and after calibrating the apparatus itself so as to output the known chromaticity or spectral reflectivity, a color measurement object 104 is measured. In this case, as the reference sample, for example, a ceramic tile is used that has a white glaze applied on the surface layer thereof, as represented by a BCRA tile that is certified by the British Ceramic Research Association (BCRA). In addition, in the case of a simple color measurement device that outputs only the chromaticity, a white resin sheet that contains titanium oxide that has a spectral reflectivity as illustrated in FIG. 10C is used. FIG. 10C is described in detail later. In a color image forming apparatus equipped with a spectral color measurement device, detected results are fed back to a calibration table or the like for correcting an exposure amount, process conditions or a density-gradation characteristic of an image forming section. It is thereby possible to control the density or chromaticity of an image formed on a recording material.

In addition, a method for self-cleaning inside an image forming apparatus or processing for correction accompanying aged deterioration that are performed for the purpose of maintaining the color measurement accuracy of a color measurement device are proposed, for example, in Japanese Patent Application Laid-Open No. H11-216938 and Japanese Patent Application Laid-Open No. 2006-214968. For example, as in the case of a spectral color measurement device 100 illustrated in FIG. 10B, a configuration is known that includes a protective glass or a protective sheet for protecting the color measurement device from paper powder and dust that is generated inside the image forming apparatus. Because paper powder and dust adheres to the surface of a protective glass or protective sheet 111, for example, Japanese Patent Application Laid-Open No. H11-216938 proposes a method for cleaning the measurement surface of the color measurement device. The cleaning method described in Japanese Patent Application Laid-Open No. H11-216938 is effective for a configuration in which a gap between a reference sample that is disposed inside the image forming apparatus and the color measurement device is small (approximately 0.2 mm or less). Further, Japanese Patent Application Laid-Open No. 2006-214968 describes a method that focuses on the slope of a reference spectrum of a reference sample and the slope of a spectrum obtained by measuring the current reference sample, calculates a correction coefficient utilizing the inclination in the slope regions, and reflects the correction coefficient in a color measurement result. The method described in Japanese Patent Application Laid-Open No. 2006-214968 is effective with respect to deterioration of a light source and deterioration of a reference sample.

However, according to the method for cleaning the measurement surface of a color measurement device described in Japanese Patent Application Laid-Open No. H11-216938, in practice, the configuration that is adopted has a slight gap (approximately 0.2 mm to 2 mm) is provided in order to reduce the conveyance load when conveying a medium (recording material such as paper). Therefore, it is not possible to completely eliminate stains such as paper powder and dust on the color measurement surface of the color measurement device or the reference sample, and there is also the concern that mist or volatile colored gas or the like adhering to the color measurement surface or the reference sample cannot be removed. Further, according to the method described in Japanese Patent Application Laid-Open No. 2006-214968, variations in the amount of received light (variations in stray light) due to inner surface reflection that are caused by paper powder or colored adhering substances that adhere to the protective glass cannot be corrected when performing color measurement. That is, since the amount of received light increases when a large amount of return light is produced by adhering substances, when the same measurement object is measured, the difference in the return light is reflected as it is in the calculated result for the chromaticity that is obtained by the color measurement device. Therefore, particularly with respect to a measurement object that has a low lightness, there is the problem that the difference becomes more prominent and significantly influences the color measurement accuracy.

SUMMARY OF THE INVENTION

The present invention has been made in view of the above described circumstances, and a purpose of the present invention is to improve the color measurement accuracy of a color measurement device.

Another purpose of the present invention is to provide an image forming unit that forms a patch image including patches of a plurality of gradations on a recording material, a fixing unit that fixes the patch image that is formed by the image forming unit, a measurement unit that irradiates light onto the patch image that is fixed by the fixing unit, and measures reflected light from the patch image; a reference plate that is arranged facing the measurement unit, and a control unit that controls a density or a chromaticity of an image based on a result obtained by measuring the patch image and a result obtained by measuring the reference plate by means of the measurement unit, wherein the control unit corrects information for controlling a density or a chromaticity of an image based on a result obtained by measuring a patch of a predetermined lightness and a result obtained by measuring the reference plate by means of the measurement unit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Modes for carrying out the present invention will be described in detail below by way of exemplary embodiments with reference to the attached drawings.

Configuration of Conventional Spectral Color Measurement Device

Figure 10A:
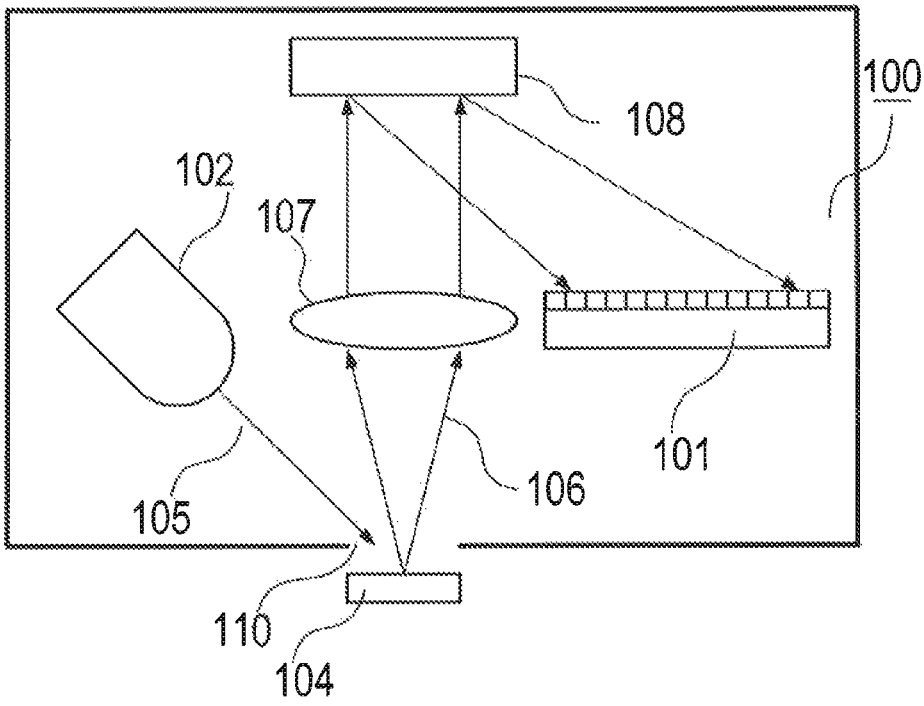
FIG. 10A and FIG. 10B are views illustrating a conventional example of the configuration of a spectral color measurement device.
Figure 10B:
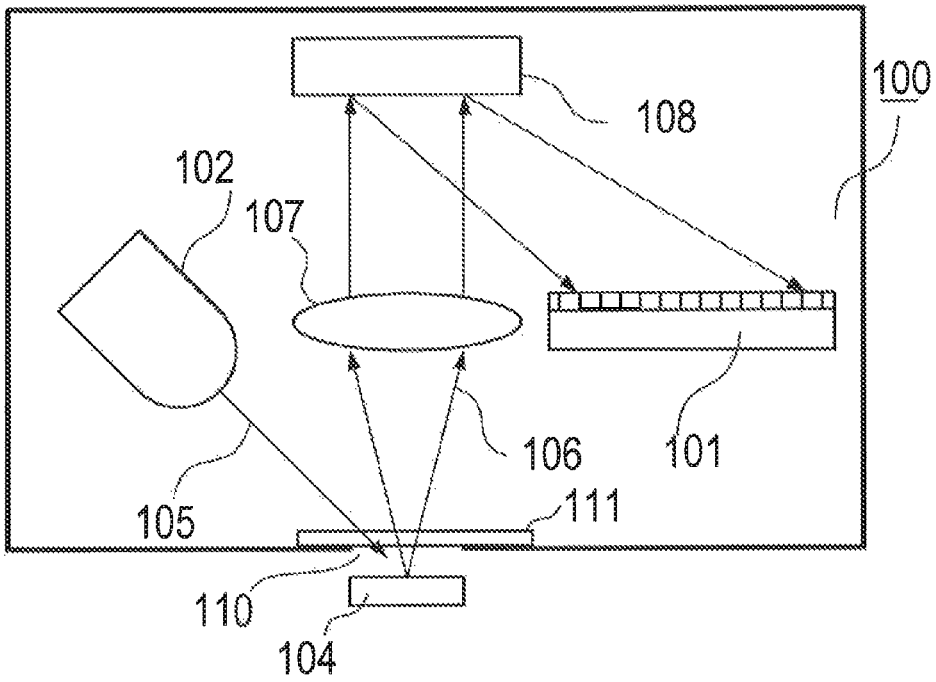
Figure 10C:
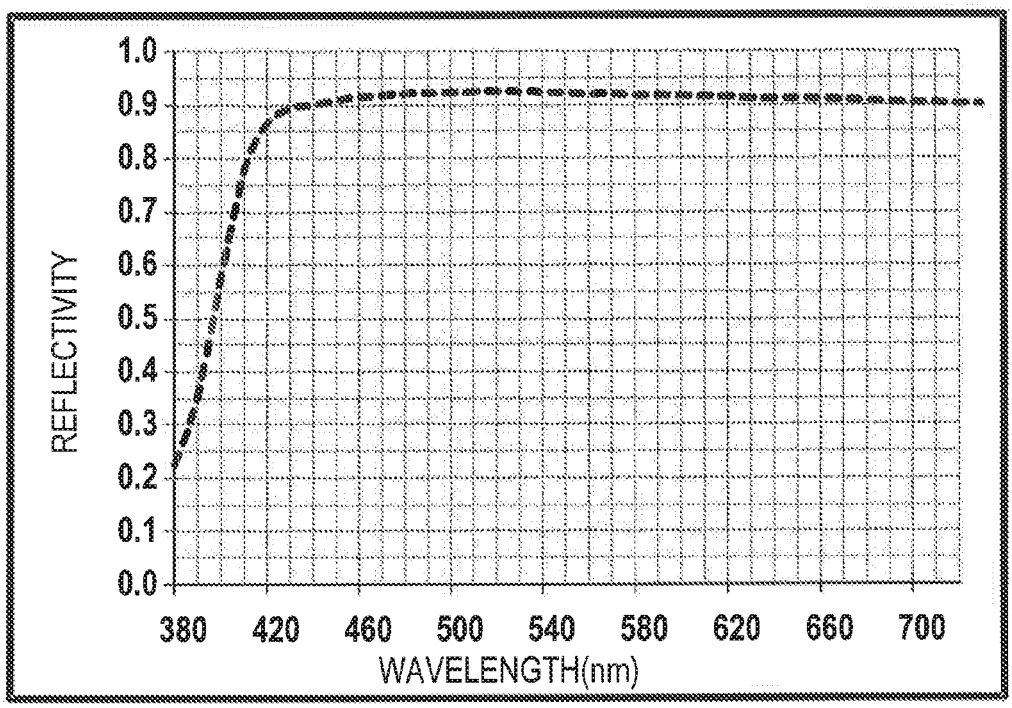
FIG. 10C is a graph illustrating the spectral reflectivity of a white reference plate.

For the purpose of comparison with the exemplary embodiments described hereunder, the configuration of a conventional spectral color measurement device will be described using FIG. 10A. A spectral color measurement device 100 has a line sensor 101 which detects scattered light which was dispersed. A light source 102 is formed of, for example, a white LED, a halogen lamp, or an LED of three colors of RGB. The light source 102 has a wavelength distribution which covers the whole visible light range. White light 105 emitted from the light source 102 passes through an opening for measurement 110 and enters a color measurement object 104 at an irradiation angle of approximately 45 degrees, and turns into diffused light in accordance with the optical absorption properties of the color measurement object 104. Among diffused light 106, a part of the light that is within the range of an incident angle of approximately 2 degrees that is an image-formation region of a condensing lens 107 is taken in thereby, and becomes parallel light. The light that has become parallel light enters a reflection-type diffraction grating 108 at an incident angle of 0 degrees, and is dispersed by the reflection-type diffraction grating 108. The scattered light that was dispersed enters the line sensor 101. Lights of respectively different wavelength ranges that were dispersed by the reflection-type diffraction grating 108 enter each pixel of the line sensor 101, and the intensity for each wavelength of the scattered light that was reflected by the color measurement object 104 is obtained by obtaining the output of each pixel. Note that FIG. 10B illustrates a configuration in which a protective glass or protective sheet 111 is provided at the opening for measurement 110, and components in FIG. 10B that are the same as in FIG. 10A are denoted by like reference numerals and a description of such components is omitted. Further, FIG. 10C illustrates the spectral reflectivity of, for example, a white resin sheet containing titanium oxide that is used as a reference sample. In FIG. 10C, the abscissa axis represents the wavelength (nm) and the axis of ordinates represents the reflectivity.

Exemplary Embodiment 1

Configuration of Spectral Color Measurement Device

Figure 1A:
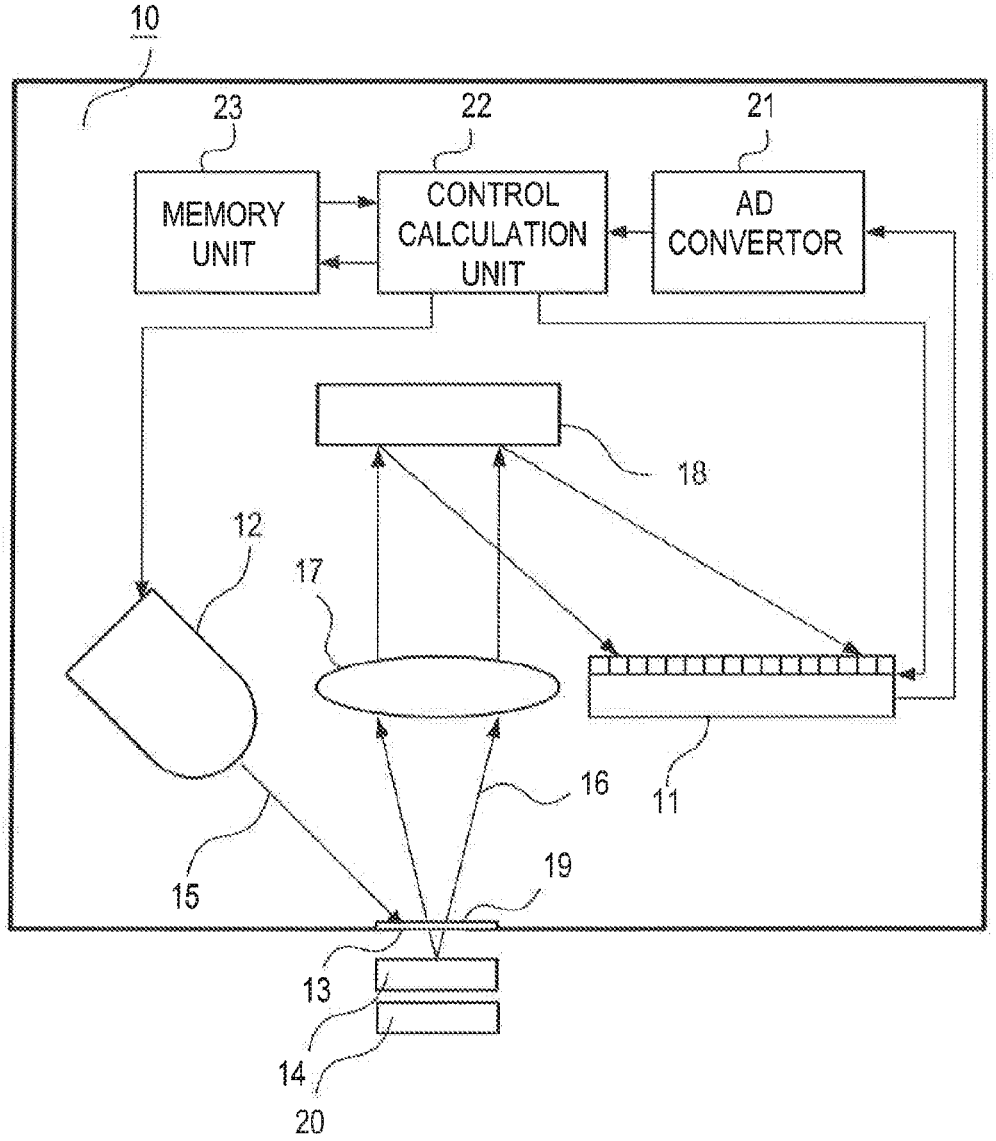
FIG. 1A and FIG. 1B are schematic configuration diagrams that illustrate a spectral color measurement device according to Exemplary Embodiments 1 to 3.
Figure 1B:
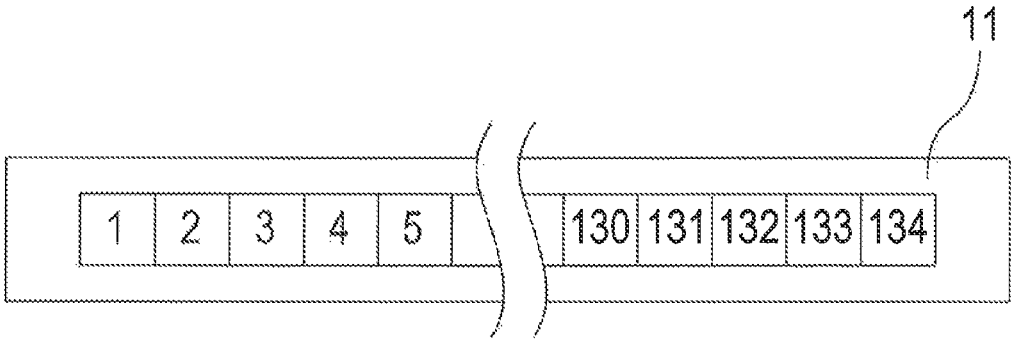

Schematic views of a spectral color measurement device used in Exemplary Embodiment 1 are illustrated in FIG. 1A and FIG. 1B. A spectral color measurement device 10 in FIG. 1A includes a white light source 12 having an emission wavelength distribution across the entire visible light range, a condensing lens 17, a reflection-type diffraction grating 18 and a charge-accumulation-type line sensor (hereunder, referred to simply as "line sensor") 11. The spectral color measurement device 10 that is a measurement unit has a protective glass 19 whose purpose is to protect an opening 13 of the sensor from the entry of dust or paper powder. Light 15 that is emitted from the white light source 12 passes through the opening 13 and the protective glass 19. The light 15 enters a color measurement object 14 (for example, a patch image T that is described later) formed on a recording material P at an incident angle of approximately 45 degrees, and turns into diffused light in accordance with the light absorption properties of the color measurement object 14. A part of diffused light 16 that is within the range of a light-condensing region of the condensing lens 17 is taken in by the condensing lens 17 and turned into parallel light, and thereafter enters the reflection-type diffraction grating 18 at an incident angle of 0 degrees and is dispersed. The scattered light which has been dispersed enters the line sensor 11.

As shown in FIG. 1B, the line sensor 11 of the present exemplary embodiment includes 134 pixels which are necessary for detecting visible light having a wavelength of approximately 350 nm to approximately 750 nm in units of approximately 3 nm. Note that, in FIG. 1B, numbers are assigned in the order of 1, 2, . . . , 134 as address numbers of the respective pixels to distinguish the respective pixels. Since the light that enters the line sensor 11 has been dispersed by the reflection-type diffraction grating 18, the respective pixels of the line sensor 11 correspond to respective wavelengths of incident light. In the line sensor 11, each pixel accumulates an optical charge in accordance with the intensity of the scattered light that enters therein. By control of the control calculation unit 22, the accumulated charges of the line sensor 11 are converted to voltages and are sequentially output as voltage signals. The output voltage signals are subjected to AD conversion by an AD convertor 21, and the control calculation unit 22 can obtain the reflected light from the color measurement object 14 as a digital signal for each pixel. The line sensor 11 used in the present exemplary embodiment is a charge-accumulation-type line sensor, and each pixel of the line sensor 11 outputs a voltage signal according to the intensity of scattered light that entered therein in a predetermined accumulation time period. The accumulation time period of the line sensor 11 can be appropriately adjusted by the control calculation unit 22. Further, a white-colored reference plate (hereinafter referred to as "white reference plate") 20 for correcting the spectral color measurement device 10 is disposed at a position facing the spectral color measurement device 10. Accordingly, in some cases the patch image T, described later, that is formed on the recording material P corresponds to the color measurement object 14 that is to be measured by the spectral color measurement device 10 and in some cases the white reference plate 20 corresponds to the color measurement object 14.

Method for Determining Spectral Reflectivity Or(λ) of Color Measurement Object

A digital signal of each pixel that is output from the line sensor 11 is subjected to AD conversion by the AD convertor 21 and input to the control calculation unit 22. The following calculation is performed by the control calculation unit 22. For each pixel of the line sensor 11, an address number n of the respective pixels (according to the present exemplary embodiment, n=1 to 134) (see FIG. 1B) and a wavelength λ of light corresponding to the respective pixels are relatively associated in advance (hereunder, described as "value setting"). The address number n and wavelength λ that are associated with each other (that is, subjected to value setting) of the respective pixels are stored in a memory unit 23. The value setting operation can be conducted by means of a conventional known method, for example, using a reference single wavelength spectrum for which a wavelength λ is known at the time of shipping the line sensor 11. When each pixel of the line sensor 11 and a wavelength λ are associated with each other in this manner, a wavelength-signal intensity spectrum Oi(λ) of the reflected light from the color measurement object 14 is obtained based on the voltage signal output for each pixel of the line sensor 11 as described above.

In this case, a wavelength-signal intensity spectrum of reflected light when light of the white light source 12 is irradiated at a reference sample (usually, a white colored reference sample; hereunder also referred to as "white reference") for which a previously measured spectral reflectivity is known is taken as Wi(λ). The spectrum Wi(λ) is a spectrum obtained when the white reference is subjected to color measurement (also referred to as "measurement") by the spectral color measurement device 10. In a case where a stain adheres to the protective glass 19, the spectrum Wi(λ) is a spectrum measured in a state that also includes the stain. The wavelength-signal intensity spectrum of the reference sample is taken as Wr(λ). The spectrum Wr(λ) is the spectrum of the white reference that was exactly measured in an ideal environment without any stains or the like. Further, the spectral reflectivity of the color measurement object 14 is taken as Or(λ). The spectral reflectivity Or(λ) of the color measurement object 14 is determined by the following equation.

$$Or(\lambda)=\{Oi(\lambda)/Wi(\lambda)\}\times Wr(\lambda) \quad \text{Equation (1)}$$

Figure 1C:
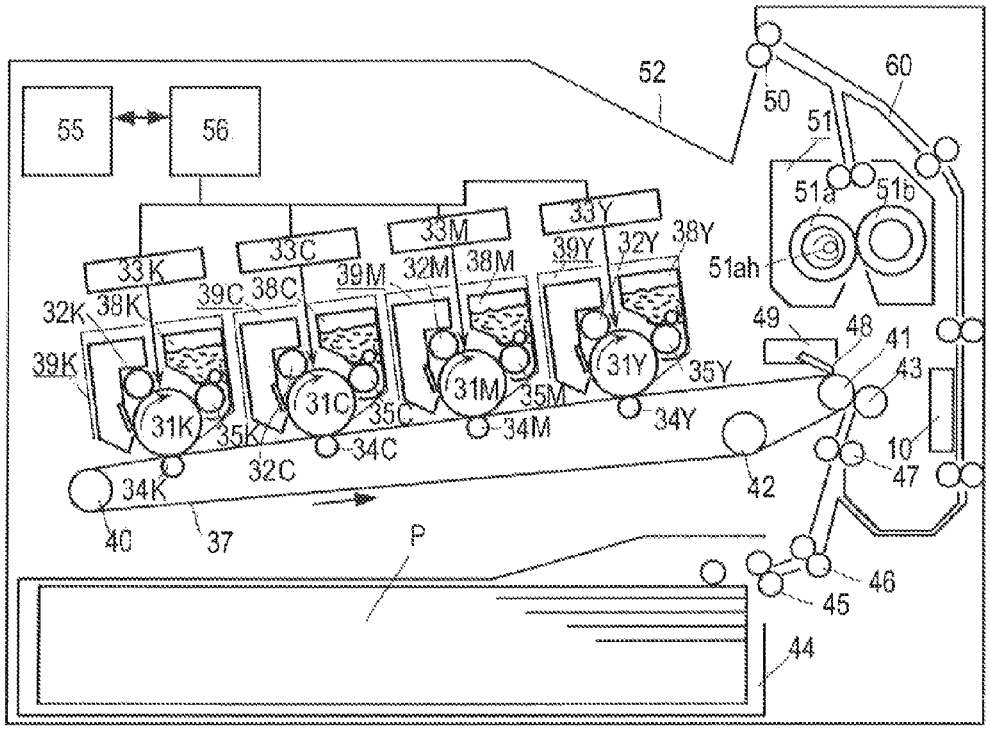
FIG. 1C is a configuration diagram of an image forming apparatus.

Furthermore, the control calculation unit 22 performs an interpolation operation for the spectral reflectivity in the range from 380 nm to 730 nm in units of 10 nm based on the spectral reflectivity Or(λ) of the color measurement object 14 obtained from Equation (1), and outputs the result obtained to the outside (for example, a control unit 55 that is described later; see FIG. 1C).

When measuring the color measurement object 14 with the spectral color measurement device 10 of the present exemplary embodiment, first, the control calculation unit 22 replaces the wavelength λ in Equation (1) with the pixel address n (Or(n)={Oi(n)/Wi(n)}×Wr(n)). The control calculation unit 22 then calculates Oi(n)/Wi(n) for each pixel based on the previously measured output signal Wi(n) of the white reference and an output signal Oi(n) from the line sensor 11 when the color measurement object 14 was measured. Here, the previously measured output signal Wi(n) of the white reference is a value that is determined by processing in S118 in FIGS. 6A and 6B that are described later (the same applies to FIGS. 8A and 8B, and FIGS. 9A, 9B and 9C). Thereafter, a relation between each pixel n of the line sensor 11 and a wavelength λ which were associated with each other is read out from the memory unit 23, and the pixel address n is replaced with the wavelength λ to obtain Oi(λ)/Wi(λ). Further, the control calculation unit 22 reads out a value of Wr(λ) stored in the memory unit 23, and the spectral reflectivity Or(λ) of the color measurement object 14 can be obtained in accordance with Equation (1). That is, when the color measurement object 14 is measured by the spectral color measurement device 10, the control calculation unit 22 corrects the output signal Oi(n) of the line sensor 11 based on the measurement value Wi(n) of the white reference, and thus outputs the spectral reflectivity Or(λ) to outside.

Configuration of Color Image Forming Apparatus

The spectral color measurement device 10 of the present exemplary embodiment can be used in an electrophotographic color image forming apparatus, for example. FIG. 1C is a configuration diagram that illustrates a tandem color image forming apparatus adopting an intermediate transfer belt which is one example of an electrophotographic color image forming apparatus. Note that a color image forming apparatus, described later, to which the spectral color measurement device 10 can be applied is not limited to an electrophotographic color image forming apparatus, and for example, the spectral color measurement device 10 may also be applied to a color image forming apparatus of an inkjet type or other type. The operation of an image forming section of the image forming apparatus used in the present exemplary embodiment will now be described using FIG. 1C.

The image forming section includes a sheet feeding cassette 44, photosensitive members (hereinafter referred to as "photosensitive drum") 31Y, 31M, 31C and 31K for each station of each color of YMCK, and charging rollers 32Y, 32M, 32C and 32K which serve as charging units. The image forming section also includes scanners for exposure 33Y, 33M, 33C and 33K, and developing devices 38Y, 38M, 38C and 38K which serve as developing units. Further, the image forming section includes an intermediate transfer belt 37, a driving roller 41 for driving the intermediate transfer belt 37, a tension roller 40, an auxiliary roller 42, and primary transfer rollers 34Y, 34M, 34C and 34K. The image forming section also includes a secondary transfer roller 43, a fixing unit, a control unit 55 for controlling and operating these components, and a controller 56. Note that the suffixes Y, M, C and K that are added to the reference numerals represent the colors yellow, magenta, cyan and black, respectively, and hereunder YMCK are omitted unless it is necessary to make specific distinctions. The photosensitive drum 31 is formed of an aluminum cylinder that has an organic photoconductive layer applied on the outer periphery thereof, and rotates by means of a driving force transmitted from a driving motor that is not shown in the drawings. The driving motor causes the photosensitive drum 31 to rotate in the clockwise direction (direction of the arrow in FIG. 1C) in accordance with an image forming operation.

When the control unit 55 receives an image signal, a recording material P is fed out from the sheet feeding cassette 44 or the like into the image forming apparatus by sheet feeding rollers 45 and 46. The recording material P is temporarily nipped by a pair of registration rollers 47 that are roller-like synchronous rotation members for synchronizing an image forming operation and conveyance of the recording material P as described later, and the recording material P is stopped to wait at that position. On the other hand, the controller 56 causes the scanner for exposure 33 to form an electrostatic latent image in accordance with the received image signal on the surface of the photosensitive drum 31 which has been charged to a fixed potential by the action of the charging roller 32. The developing devices 38 are units for visualizing electrostatic latent images, and perform development of yellow (Y), magenta (M), cyan (C) and black (K) for each station. A sleeve 35 is provided in each developing device 38, and a developing bias for visualizing the electrostatic latent image is applied thereto. Thus, the electrostatic latent images formed on the surfaces of the respective photosensitive drums 31 are developed as single-color toner images by the action of each developing device 38. The photosensitive drum 31, the charging roller 32 and the developing device 38 for each color constitute an integral structure, and are mounted in the form of a toner cartridge 39 which is detachable from the main body of the image forming apparatus.

The intermediate transfer belt 37 comes into contact with the photosensitive drums 31Y, 31M, 31C and 31K and rotates in the counterclockwise direction in synchrony with rotation of the photosensitive drums 31Y, 31M, 31C and 31K when forming a color image. The single-color toner images that are developed on the respective photosensitive drums 31 are sequentially superimposed and transferred onto the intermediate transfer belt 37 by the action of a primary transfer bias applied to each of the primary transfer rollers 34 so as to form a multicolor toner image on the intermediate transfer belt 37. Thereafter, the multicolor toner image formed on the intermediate transfer belt 37 is conveyed to a secondary transfer nip section formed between the driving roller 41 and the secondary transfer roller 43. At the same time, the recording material P which had been waiting in the state of being nipped between the pair of registration rollers 47 is conveyed to the secondary transfer nip section by an action of the pair of registration rollers 47 in synchronization with the multicolor toner image on the intermediate transfer belt 37. Subsequently, the multicolor toner image on the intermediate transfer belt 37 is collectively transferred onto the recording material P by an action of a secondary transfer bias applied to the secondary transfer roller 43.

The fixing unit 51 melts and fixes the multicolor toner image that was transferred onto the recording material P, while conveying the recording material P. The fixing unit 51 includes a fixing roller 51*a* for heating the recording material P, and a pressure roller 51*b* for pressing the recording material P against the fixing roller 51*a*. The fixing roller 51*a* is formed in a hollow shape, and contains a heater 51*ah* therein. The recording material P bearing the multicolor toner image is conveyed by the fixing roller 51*a* and the pressure roller 51*b*, and heat and pressure are applied to the recording material P by the fixing roller 51*a* and the pressure roller 51*b* so that the toner is fixed to the surface of the recording material P.

The recording material P after fixing of the toner image thereon is discharged to a sheet-discharge tray 52 by sheet-discharge rollers 50 to thereby end the image forming operation in the case of one-sided printing. On the other hand, in the case of double-sided printing, to perform image formation on the second side of the recording material P, the recording material P passes through a double-sided conveyance path 60 by means of a switch-back operation at a sheet-discharging section, and is temporarily nipped by the pair of registration rollers 47 again to stop and wait. Thereafter, the above-described series of image forming operations is performed to form an image on the second side of the recording material P. A cleaning apparatus 48 removes toner remaining on the intermediate transfer belt 37. The toner which is collected by the cleaning apparatus 48 is stored in a cleaner container 49.

Figure 2A:
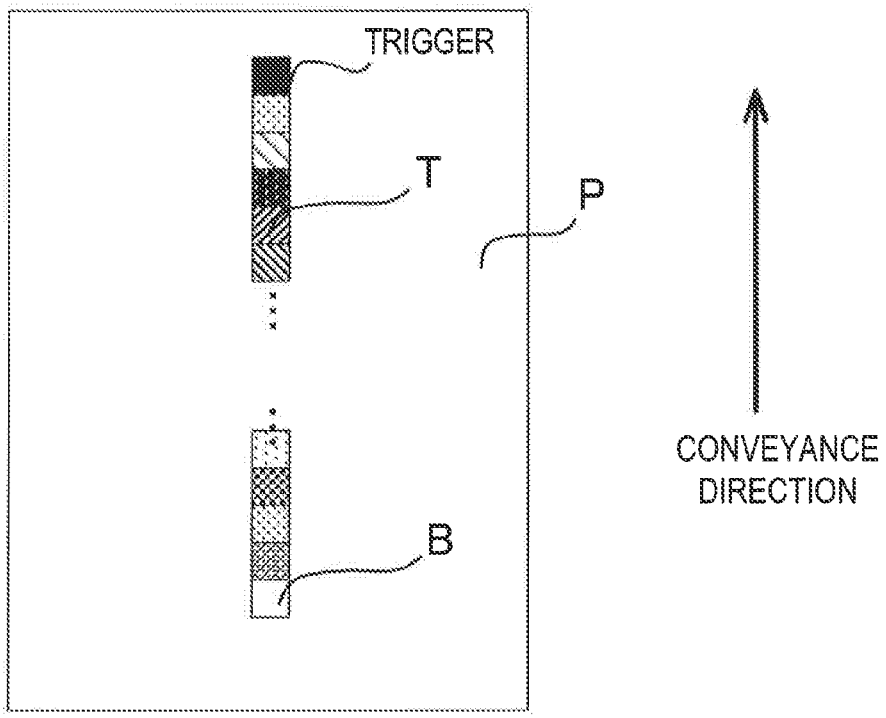
FIG. 2A is a view that illustrates a patch image for color measurement according to Exemplary Embodiment 1.

The spectral color measurement device 10 of the present exemplary embodiment is arranged at a center position of the double-sided conveyance path 60 in a longitudinal direction in order to measure a color of a toner image (hereunder, referred to as "toner patch") as a measurement object that is formed at specified intervals and in a specified shape on the recording material P. More specifically, on the double-sided conveyance path 60, the spectral color measurement device 10 is arranged at a center part in a direction that is orthogonal to the conveyance direction of the recording material P. Note that, a position at which the spectral color measurement device 10 is arranged is not limited to a center position in a longitudinal direction. Further, it is assumed that a toner patch which is measured by the spectral color measurement device 10 is formed on the recording material P in accordance with the position of the spectral color measurement device 10. In addition, the spectral color measurement device 10 may be arranged at a position at which the toner patch can be measured before the recording material P is discharged to outside the image forming apparatus after the process of fixing the toner patch on the recording material P ends. When an operation to measure a color of the toner patch with the color measurement device 10 starts, first, by the series of image forming operations that were initially described above, a patch image T for color measurement that is illustrated, for example, in FIG. 2A, is formed on the recording material P. As shown in FIG. 2A, the patch image T as a toner patch has a shape in which patches having different gradations are formed in succession in the conveyance direction of the recording material P. In the patch image T, a patch that is located at the top of the recording material P in the conveyance direction is taken as a trigger patch (indicated by "trigger" in FIG. 2A). Note that the trigger patch of the patch image T is used for stray light correction that is described later, and also has a function as a trigger for detecting the timing of color measurement. A description regarding reference character B in FIG. 2A is provided later in Exemplary Embodiment 3.

The recording material P that has passed through the fixing unit 51 is conveyed to the double-sided conveyance path 60 by a switch-back operation in the sheet-discharging section. Subsequently, the spectral color measurement device 10 arranged in the double-sided conveyance path 60 sequentially measures the color of the patch image T formed on the recording material P in synchronization with conveyance of the recording material P based on the trigger patch. When color measurement by the spectral color measurement device 10 ends, after passing through the pair of registration rollers 47, the recording material P passes through a secondary transfer section and the fixing unit 51 so as to be discharged onto the sheet-discharge tray 52 by the sheet-discharge rollers 50. This series of image forming operations is controlled by the control unit 55 arranged in the image forming apparatus.

Image Forming Operation

Figure 2B:
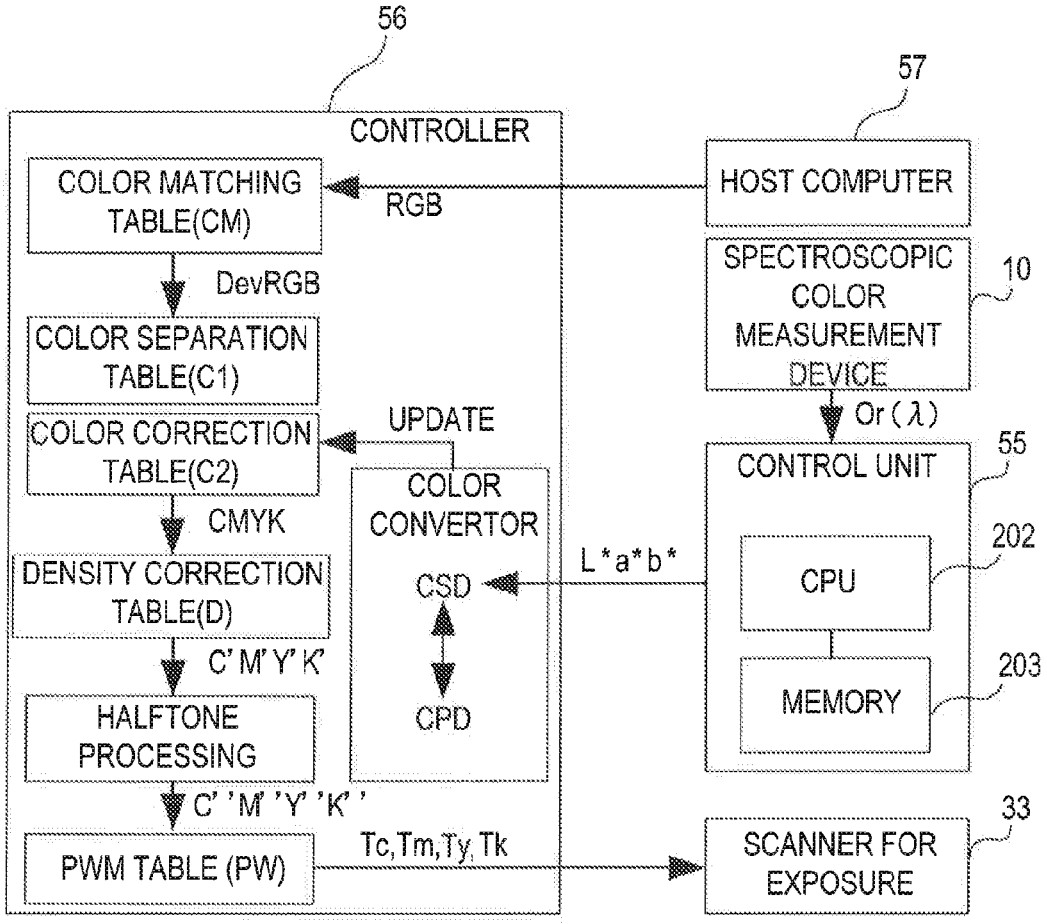
FIG. 2B is a block diagram of an image forming apparatus according to Exemplary Embodiments 1 to 3.

Next, an example of an image forming operation in the image forming apparatus of the present exemplary embodiment is described using the block diagram illustrated in FIG. 2B. The controller 56 and the control unit 55 of the image forming apparatus are connected to each other through a video interface (not shown), and the controller is connected to a host computer 57 of an external terminal or to network (not shown). A color matching table (CM) to be used for color conversion, a color separation table (C1) and a density correction table (D) are stored in a storage section of the controller 56. In addition, the control unit 55 includes a CPU 202 for performing processing with respect to image forming operations and color measurement results from the color measurement device 10, and a memory 203 for temporarily storing a measurement result from the spectral color measurement device 10.

When the image forming operation starts, the controller 56 performs the following processing. The controller 56 converts RGB signals indicating the colors of an image transmitted from the host computer or the like into device RGB signals that are adapted to a color reproduction range of the color image forming apparatus, using the color matching table (CM) which has been prepared beforehand. Hereinafter, the device RGB signals adapted to the color reproduction range of the color image forming apparatus are referred to as "DevRGB signals". Next, using the color separation table (C1) and the color correction table (C2), which will be described later, the controller 56 converts the DevRGB signals into CMYK signals which are the colors of toner color materials of the color image forming apparatus. Note that the color correction table (C2) is a table in which the data of the table is updated in accordance with a color measurement operation of the present exemplary embodiment that is described later.

Further, using the density correction table (D) for correcting gradation/density characteristics inherent to each color image forming apparatus, the controller 56 converts the CMYK signals to C'M'Y'K' signals to which the correction of the gradation/density characteristics has been added. The controller 56 then subjects the resultant signals to half-tone processing to convert the C'M'Y'K' signals to C"M"Y"K" signals. Thereafter, the controller 56 converts the C"M"Y"K" signals to exposure time periods Tc, Tm, Ty and Tk using a PWM (Pulse Width Modulation) table (PW). The exposure time periods Tc, Tm, Ty and Tk are exposure time periods for the scanners for exposure 33C, 33M, 33Y and 33K that correspond to the C"M"Y"K" signals. The controller 56 controls the scanners for exposure 33C, 33M, 33Y and 33K in accordance with these exposure time periods Tc, Tm, Ty and Tk. Thus, the controller 56 forms electrostatic latent images on the surfaces of the photosensitive drums 31C, 31M, 31Y and 31K, and the above-described series of image forming operations is performed.

Further, as shown in FIG. 2A, in an operation to measure the color of the patch image T by the spectral color measurement device 10, the patch image T for color measurement is formed on the recording material P. At this time, the controller 56 forms the patch image T in accordance with multiple items of color patch data (CPD) in CMYK format that are previously stored in the controller 56. The patch image T may include patches of a single color or may include patches having a mixture of colors. The color of the patch image T for color measurement which has been formed on the recording material P is measured with the spectral color measurement device 10. A spectral reflectivity Or(λ) for each patch is calculated by the control calculation unit 22 based on data (the aforementioned Oi(n)) that was read by the line sensor 11 of the spectral color measurement device 10, and the result obtained is output to the control unit 55.

The data for each spectral reflectivity Or(λ) that was output by the spectral color measurement device 10 is converted to chromaticity values (for example, CIE L*a*b*) by the action of the control unit 55, and is sent to a color conversion section of the controller 56. The color conversion section of the controller 56 converts the chromaticity values (L*a*b*) that were sent from the control unit 55 to CMYK format data (CSD) utilizing a color management system (CMS) (not shown). The CMYK format data (CSD) is data that depends on the image forming apparatus. Thereafter, the color conversion section of the controller 56 compares the converted CMYK data (CSD) with the default color patch data (CPD). As a result, the controller 56 generates a color correction table (C2) for correcting a difference between the converted CMYK data (CSD) and the default color patch data (CPD) and updates the table.

Although the above described processing is performed for all patch images T for color measurement which have undergone color measurement, the patch image T that is subjected to color measurement does not necessarily need to include all colors that can be reproduced by the image forming apparatus. With regard to CMYK data for which an image has not been formed as a patch image T for color measurement on the recording material P, the correction table (C2) may be created by conducting interpolation processing based on the patch images T whose colors were measured. The correction table (C2) created in this way is updated and stored in the controller 56 together with the color separation table (C1).

White Light Source Used in Spectral Color Measurement Device

Next, the white light source 12 that is used when performing color measurement by means of the spectral color measurement device 10 according to the present exemplary embodiment will be described in detail. When measuring the color of printed material or the color of an object by means of the spectral color measurement device 10, the measurement can be performed in the following manner, as described, for example, in JIS 28722. That is, when performing strict measurement of colors by means of the spectral color measurement device 10, it is desirable to measure the intensity in a wavelength region from 380 nm to 780 nm, or in a wavelength region from 400 nm to 700 nm even in the case of a simple color measurement.

Figure 3A:
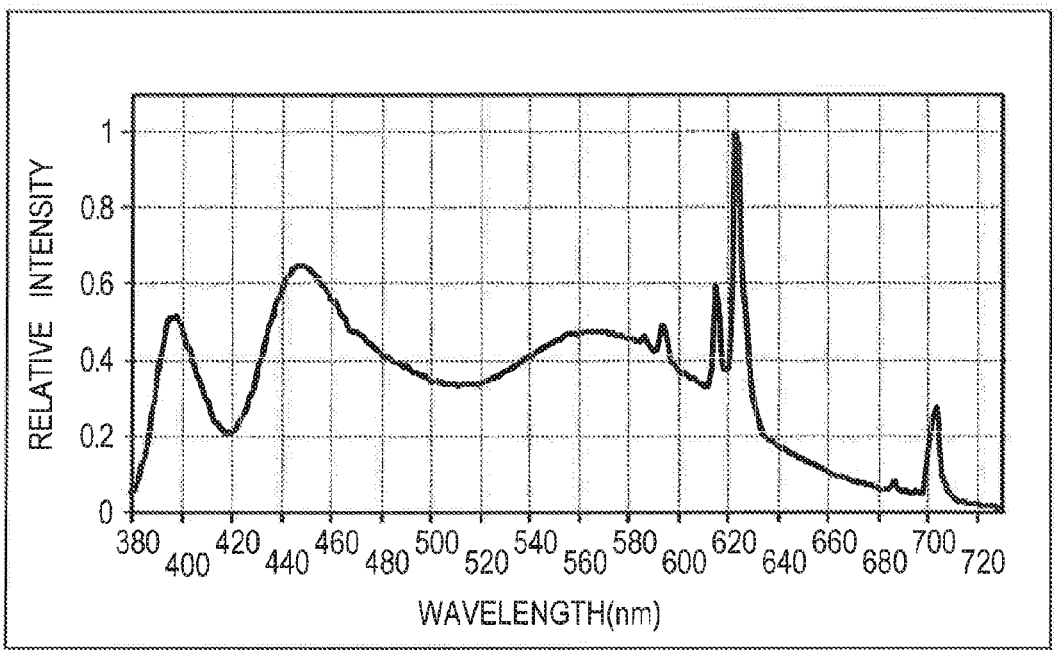
FIG. 3A is a view illustrating a spectrum of an LED package according to Exemplary Embodiments 1 to 3.

Therefore, according to the present exemplary embodiment, a light source such as an LED package having an emission spectrum as illustrated in FIG. 3A is used as the white light source 12. In FIG. 3A, the abscissa axis represents the wavelength (nm), and the axis of ordinates represents the relative intensity. As shown in FIG. 3A, the emission spectrum of the white light source 12 of the present exemplary embodiment has a shape formed by combining the spectrum of the light-emitting diode having a local maximum value of the emission intensity at a wavelength of 390 nm, a blue spectrum, a yellow spectrum, and a red spectrum. Here, the blue spectrum has a local maximum value of the emission intensity at a wavelength of 450 nm, the yellow spectrum has a local maximum value of the emission intensity at a wavelength of 570 nm, and the red spectrum has a local maximum value of the emission intensity at a wavelength of 630 nm. Note that, similarly to a conventional known package, an LED package having such an emission spectrum can be obtained in an arbitrary shape or type such as a surface-mounting type, a shell type and a chip-on-board type by combining a light-emitting chip with a phosphor.

Figure 3B:
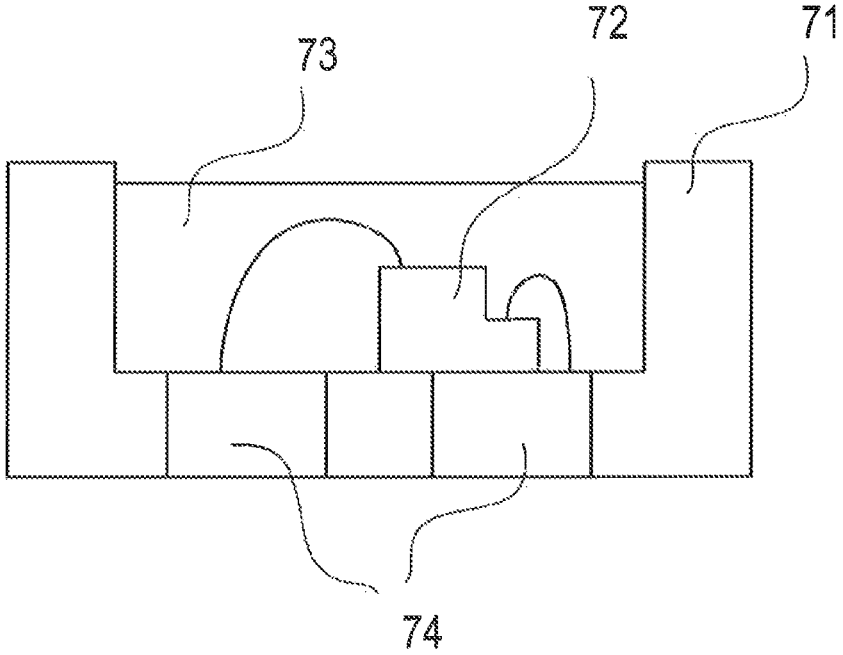
FIG. 3B is a view illustrating a configuration of an LED package according to Exemplary Embodiments 1 to 3.

A schematic structural drawing of a surface-mounting-type LED package is illustrated in FIG. 3B as a representative example of the LED package. The surface-mounting-type LED package is obtained by mounting a light-emitting diode 72 in a cavity 71 which has been molded with a ceramic, a resin or the like, and filling the cavity 71 with a resin 73 such as epoxy or silicone in which phosphors were dispersed. When a current is supplied to the light-emitting diode 72 through an electrode 74, the inherent wavelength spectrum that the light-emitting diode has is emitted therefrom. A part of the emitted spectrum excites the phosphors inside the cavity 71, and the inherent wavelength spectrum that the respective phosphors have is emitted. The emission spectrum illustrated in FIG. 3A which is used in the present exemplary embodiment is emitted by using substances which emit light of the respective wavelengths of blue, yellow and red that are described above as the phosphors.

Thus, according to the present exemplary embodiment, a configuration is adopted in which an LED package which uses a light-emitting diode having a local maximum value of the emission intensity in a near-ultraviolet region is used as the white light source 12. It is thereby possible to obtain a spectral reflectance output in the vicinity of a wavelength of 400 nm which is necessary for color measurement and for which a sufficient output cannot be obtained with a common white LED. More specifically, to obtain an output in a wavelength region that is equal to or greater than 380 nm or in a wavelength region that is equal to or greater than 400 nm, a light-emitting diode having a local maximum value of the emission intensity in a wavelength region from 380 nm to 420 nm may be used as an excitation light source. An InGaN-based light-emitting diode is widely known as such kind of light-emitting diode.

In addition, as exemplified in the present exemplary embodiment, a configuration may be adopted in which an LED package that uses a plurality of phosphors having a local maximum value of fluorescence intensity in a wavelength region from 420 nm to 730 nm, as the white light source 12. It is thereby possible to obtain a spectral reflectance output in a wavelength region from 400 nm to 700 nm that is necessary for a simple color measurement. In this case, although the composition of the phosphors that are used is not particularly limited, an oxide phosphor or a nitride phosphor can be used since these phosphors are chemically stable and prolong the life of a semiconductor light-emitting element and an illumination apparatus. In particular, a phosphor can be used that is formed by combining a metal oxide, a metal nitride, a phosphate or a sulfide with ions of a rare earth metal or ions of a metal as an activating element or a co-activating element. In this case, the metal oxide is represented by Y2O3, Zn2SiO4 and the like. The metal nitride is represented by Sr2Si5N8 and the like. The phosphate is represented by Ca5(PO4)3Cl and the like. The sulfide is represented by ZnS, SrS, CaS and the like. The rare earth metal is Ce, Pr, Nd, Pm, Sm, Eu, Tb, Dy, Ho, Er, Tm, Yb or the like. Further, the metal is Ag, Cu, Au, Al, Mn, Sb or the like. These phosphors are compositions that are used as conventionally known phosphors such as a blue phosphor, a green phosphor, a yellow phosphor, an orange phosphor and a red phosphor.

Figure 4A:
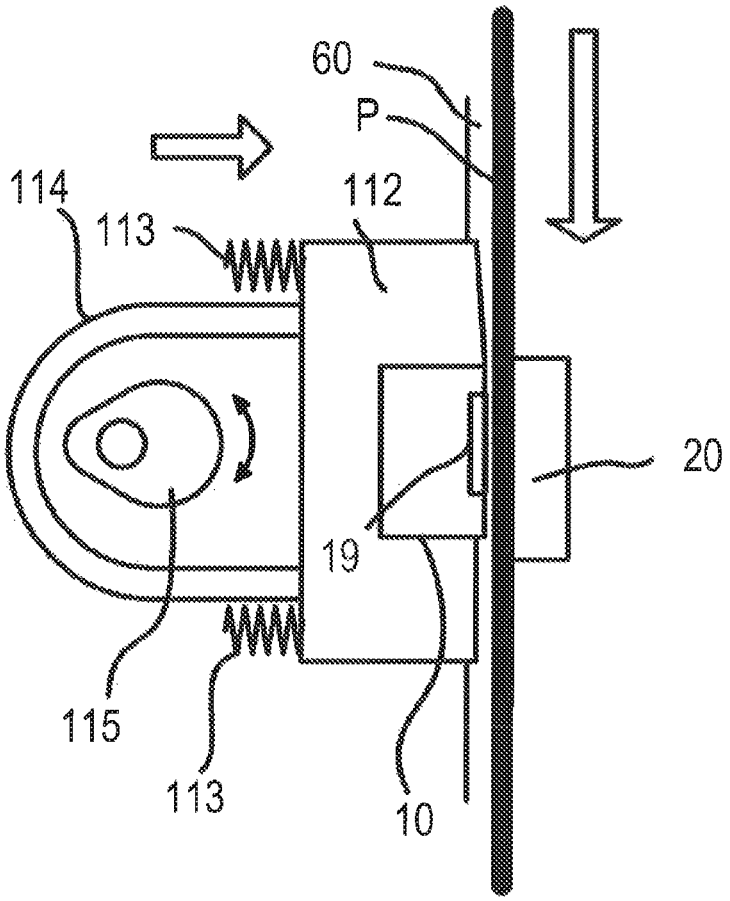
FIG. 4A and FIG. 4B are views that illustrate an installation state of the spectral color measurement device according to Exemplary Embodiments 1 to 3.
Figure 4B:
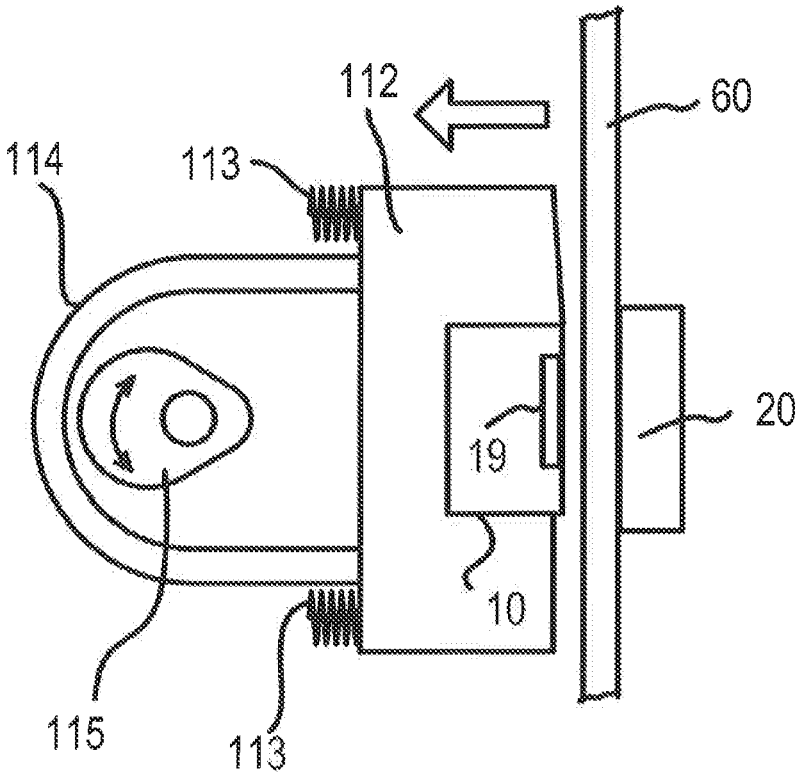

Installation State of Spectral Color Measurement Device on Double-Sided Conveyance Path FIG. 4A and FIG. 4B are detailed drawings that illustrate the installation state of the spectral color measurement device 10 on the double-sided conveyance path 60 after fixing. FIG. 4A illustrates a state in which the spectral color measurement device 10 protrudes into the double-sided conveyance path 60, and the recording material P is nipped and conveyed. On the other hand, FIG. 4B illustrates the manner in which the spectral color measurement device 10 withdraws from the double-sided conveyance path 60. In FIG. 4A, the spectral color measurement device 10 is held by a color measurement device holder 112, and the spectral color measurement device 10 is urged together with the color measurement device holder 112 by an urging spring 113 and protrudes into the double-sided conveyance path 60. The recording material P is nipped by the protective glass 19 on the surface of the spectral color measurement device 10 and the white reference plate (which is also a part facing the spectral color measurement device 10). A conveyance force is applied to the recording material P by an unshown conveyance roller, and the recording material P is conveyed along the double-sided conveyance path 60 in the conveyance direction (direction of the downward arrow in FIG. 4A) and passes through the spectral color measurement device 10. In a state in which the recording material P is passing through the spectral color measurement device 10, in synchrony with passage of the patch image T that includes a plurality of color patches that is formed on the recording material P, the spectral color measurement device 10 reads the patch image T and a color measurement operation is executed.

In a case where a color measurement operation is not to be performed by the spectral color measurement device 10, the spectral color measurement device 10 is withdrawn from the double-sided conveyance path 60 for the purpose of protecting an image formation side of the recording material P when the recording material P is conveyed along the double-sided conveyance path 60. More specifically, a cam section 115 is rotationally driven by an unshown motor or the like and the cam section 115 pushes up a lift arm section 114 of the color measurement device holder 112. The force that pushes up the lift arm section 114 of the color measurement device holder 112 overcomes the urging force of the urging spring 113, and the spectral color measurement device 10 is thus withdrawn from the double-sided conveyance path 60. This state is illustrated in FIG. 4B. In FIG. 4B, the arrow direction towards the left side in the drawing (direction perpendicular to the conveyance direction) shows the direction in which the spectral color measurement device 10 withdraws. It will be understood from the drawing that in this state the protective glass 19 that is a window portion for color measurement with respect to the inner face of the double-sided conveyance path 60 is in an open state. In the state illustrated in FIG. 4B, although there is no contact between the surface of the protective glass 19 of the spectral color measurement device 10 and the recording material P, because the protective glass 19 that is a window section for color measurement is in an open state, the protective glass 19 is exposed to dust that swirls around the inside of the image forming apparatus.

Figure 4C:
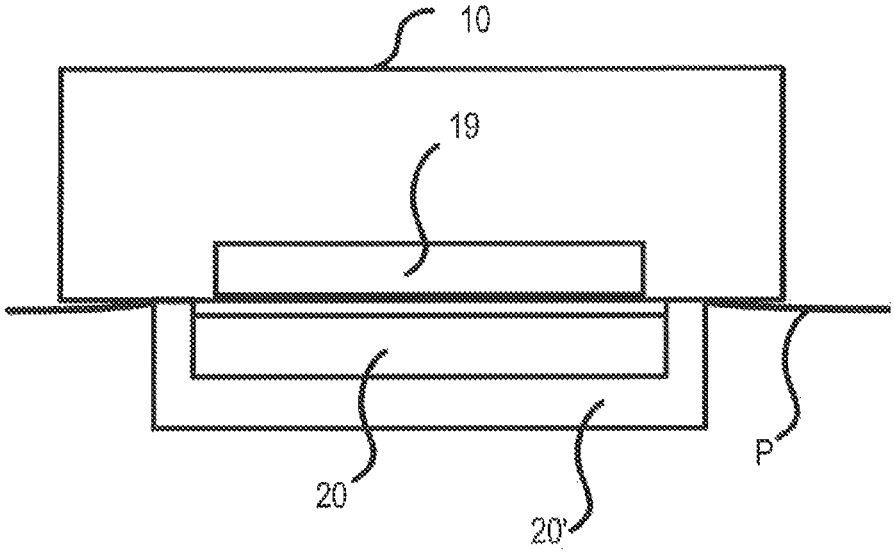
FIG. 4C is a view illustrating a contacting state between a protective glass and a position opposite the protective glass.

Further, in the state illustrated in FIG. 4A, since the recording material P contacts the surface of the protective glass 19 of the spectral color measurement device 10, an effect can be expected whereby paper powder or dust that adheres to the surface of the protective glass 19 is cleaned off by the recording material P. However, since the recording material P must be conveyed smoothly, there is a concern that bringing the protective glass 19 and the white reference plate 20 into close contact and conveying the recording material P therethrough, and furthermore, pushing the recording material P against the entire surface of the protective glass 19 and nipping and conveying the recording material P will hinder the smooth conveyance of the recording material P. Hence, it is necessary to adopt a configuration with respect to the surface of the protective glass 19 and the white reference plate 20 so that, as illustrated in FIG. 4C in which the area of contact is reduced, the recording material P comes in contact with the spectral color measurement device 10 at only a facing part holder 20' (hereunder, this configuration is referred to as "gap configuration"). Therefore, although the protective glass 19 and the recording material P contact at the portion of the facing part holder 20', the configuration has a gap such that light contact can be expected at other regions. Therefore, cleaning of the surface of the protective glass 19 depends on the posture of the recording material P. That is, a case where the protective glass 19 is cleaned normally and a case where the protective glass 19 is not cleaned and paper powder or dust remains thereon may both arise depending on the posture of the recording material P.

Figure 5A:
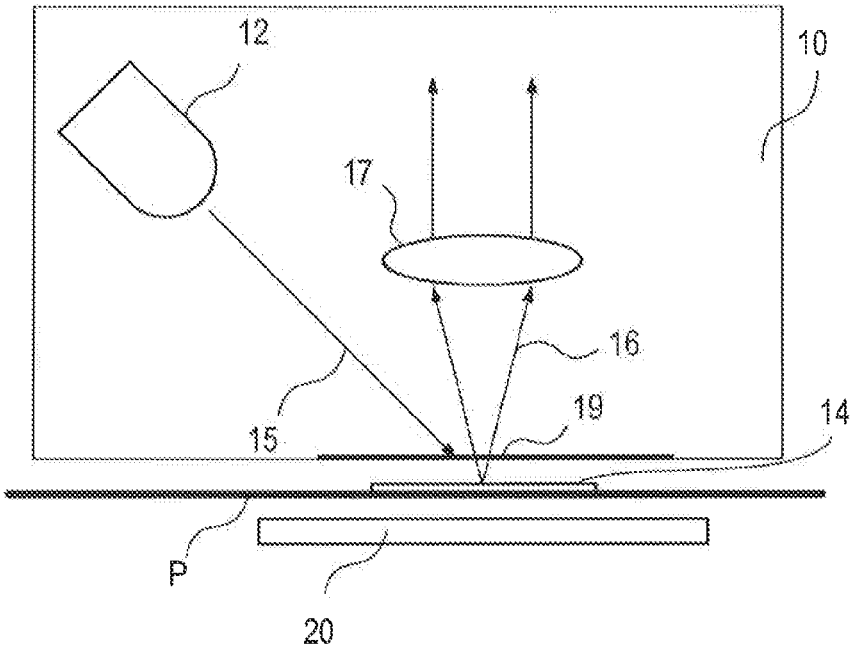
FIG. 5A and FIG. 5B are views that illustrate surface states on a protective glass according to Exemplary Embodiments 1 to 3.
Figure 5B:
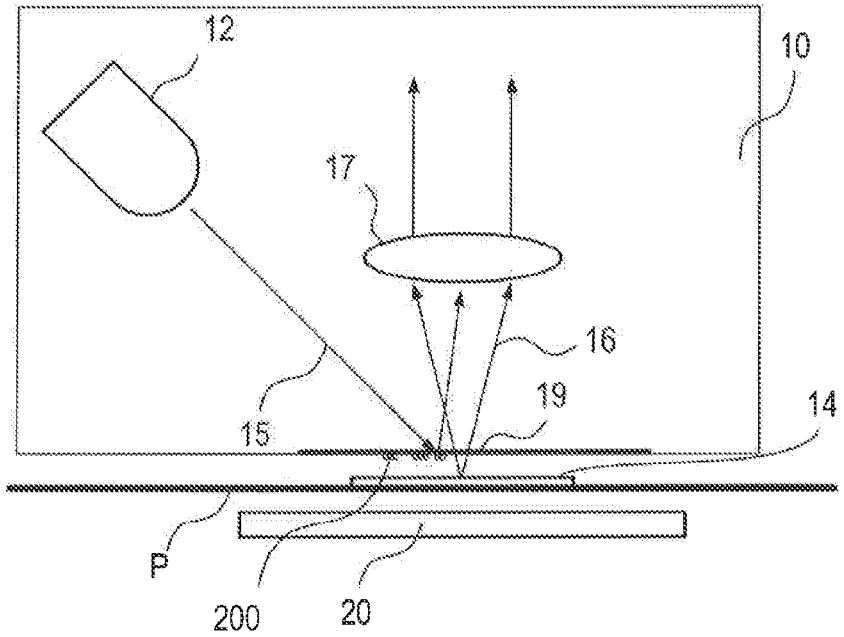
Figure 5C:
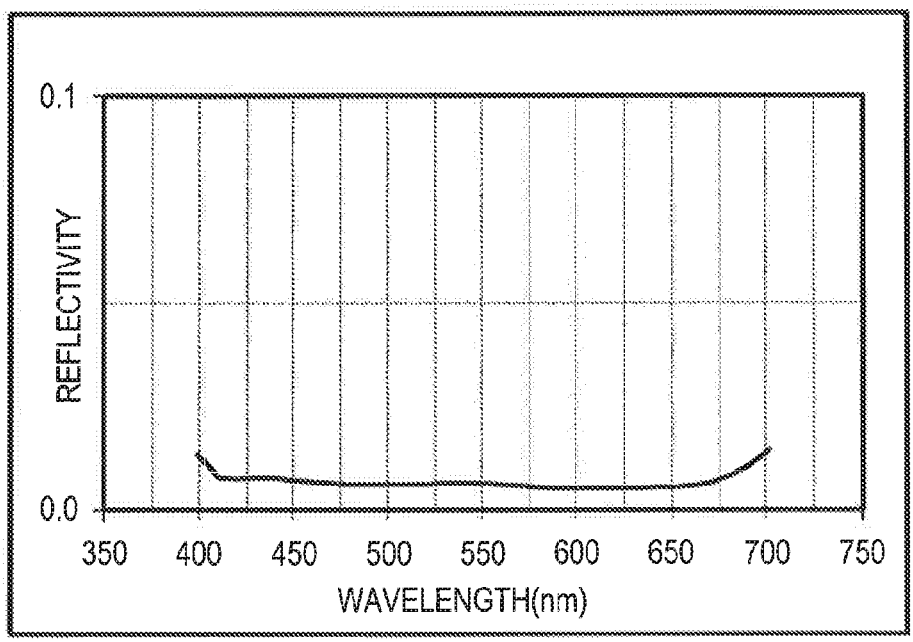
FIG. 5C and FIG. 5D are graphs that illustrate measurement results with respect to the respective surface states on the protective glass.
Figure 5D:
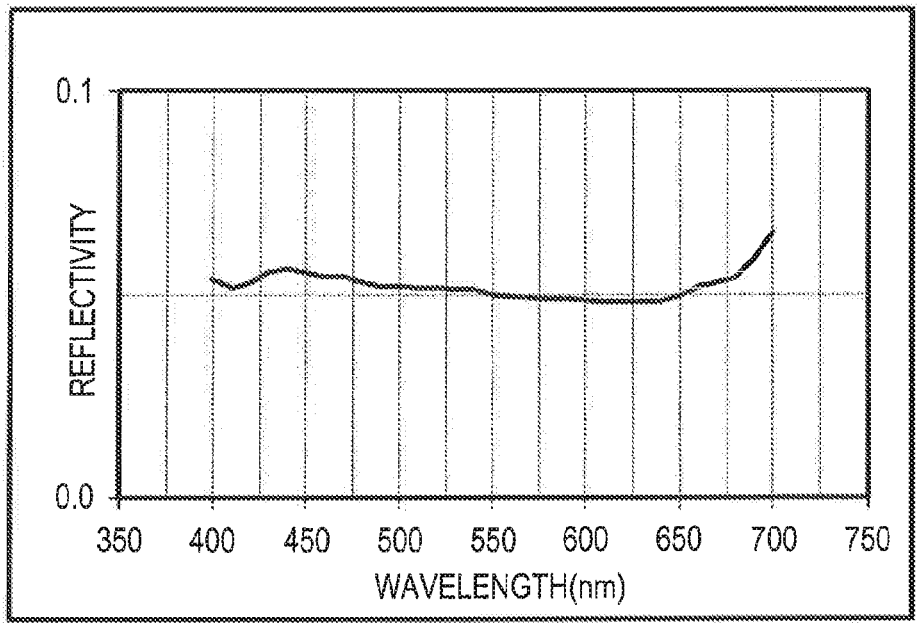

FIG. 5A and FIG. 5B illustrate states on the surface of the protective glass 19 of the spectral color measurement device 10. Note that components that are the same as components described in FIG. 1A are denoted by the same reference numerals, and a description of such components is omitted. FIG. 5A illustrates a state in which paper powder or dust is not present on the protective glass 19. On the other hand, FIG. 5B illustrates a state in which paper powder or the like 200 is adhered on the protective glass 19. Further, FIG. 5C and FIG. 5D illustrate measurement results with respect to a dark-colored (for example, black) measurement object that were acquired in the states illustrated in FIG. 5A and FIG. 5B. FIG. 5C illustrates measurement results acquired in the state in FIG. 5A, and FIG. 5D illustrates measurement results acquired in the state in FIG. 5B. In the graphs in FIG. 5C and FIG. 5D, the abscissa axis represents the wavelength (nm) and the axis of ordinates represents reflectivity. As is clear from the graphs illustrated in FIG. 5C and FIG. 5D, it was found that the measurement results differed due to the presence of the paper powder or the like 200 that adhered to the protective glass 19.

When the color measurement object 14 (hereunder, also referred to as "measurement object") on the recording material P is black, as shown in FIG. 5C, the reflectivity is low in a case where the paper powder or the like 200 is not adhered to the protective glass 19. However, in a case where the paper powder or the like 200 is adhered to the protective glass 19 as shown in FIG. 5B, the light 15 from the white light source 12 is reflected by the paper powder or the like 200, and the reflected light enters the line sensor 11. Therefore, as shown in FIG. 5D, when the paper powder or the like 200 is adhered to the protective glass 19, the reflectivity increases as a result. Thus, it is found that the paper powder or the like 200 that is adhered to the protective glass 19 significantly influences the measurement results for the same measurement object. The main cause of such influence is stray light within the spectral color measurement device 10 that is produced as a result of the light 15 from the white light source 12 being diffused at the inner face by the paper powder or the like 200 that is adhered to the protective glass 19. Hence, to perform correct color measurement in a state in which stray light is increasing, it is necessary to remove the influence of the stray light by the following procedures.

Procedures for Removal of Stray Light

The following definitions of each symbol are denoted by signal components only. Further, (λ) of the following symbols denotes a set of wavelength components for every 10 nm from 400 nm to 700 nm as spectral output. Stray light data acquired when manufacturing the spectral color measurement device 10 M1(λ)

Known white reference reflectivity W_r(λ)

Initial white reference measurement data of spectral color measurement device 10 W1 (λ)

Initial measurement data of measurement object P1(λ)

Measurement data of dark-colored measurement object acquired in a state in which paper powder or the like is not adhered to the surface of the protective glass 19 S1 (λ)

Measurement data of dark-colored measurement object acquired in a state in which paper powder or the like is adhered to the surface of the protective glass 19 S2(λ)

Current measurement data of measurement object P2(λ) Calculation data calculated by removing stray light component from current measurement data of measurement object P2' (λ)

Current white reference measurement data measured after light amount correction with respect to white reference W2 (λ)

Initial spectral reflectivity of measurement object R1(λ) Current spectral reflectivity of measurement object R2(λ) Primary correction coefficients for removing stray light from measurement data that includes stray light a, b When using the symbols that are defined as described above, the spectral reflectivity R(λ) in a state in which no stains are present on the surface of the protective glass 19, that is, an initial state, is calculated by the following Equation (2).

$$R1(\lambda)=(P1(\lambda)-M1(\lambda))/(W1(\lambda)-M1(\lambda))\times W_r(\lambda) \quad (2)$$

However, the stray light data M2(λ) at a time of measurement changes from the initial stray light data M1(λ). Consequently, when calculating the spectral reflectivity R(λ) in a state where paper powder or the like adheres to the surface of the protective glass 19, it is necessary to also remove the amount of increased stray light (in other words, M2(λ)−M1 (λ)). In this case, a proportionality relation with respect to the reflection from the respective measurement objects and the amount of received light is established between two measurement results (S1(λ) and S2(λ)) obtained by measuring the aforementioned dark-colored measurement object and two measurement results (W1(λ) and W2(λ)) obtained by measuring the white reference. Therefore, according to the present exemplary embodiment, the following linear function is applied between each of the two measurement results.

$$S1(\lambda)=a\times S2(\lambda)+b \quad (3)$$

As shown in Equation (3), a linear equation is applied with respect to the dark-colored measurement object. Next, the following linear equation is applied with respect to the measurement data of the white reference plate also.

$$W1(\lambda)=a\times W2(\lambda)+b \quad (4)$$

When coefficients a and b are calculated based on Equation (3) and Equation (4), the results are as follows.

$$a=(W1(\lambda)-S1(\lambda))/(W2(\lambda)-S2(\lambda)) \quad (5)$$

$$b=((W2(\lambda)\times S1(\lambda))-(W1(\lambda)\times S2(\lambda))/(W2(\lambda)-S1(\lambda)) \quad (6)$$

By using coefficients a and b that are calculated with Equation (5) and Equation (6), current calculation data P2' of the measurement object that is data for which stray light has been removed from the current measurement data P2(λ) of the measurement object that was measured by the spectral color measurement device 10 can be calculated by the following Equation (7). That is, P2'(λ) from which stray light has been removed can be obtained by correcting P2(λ) that is information for controlling the density or chromaticity of an image.

$$P2'(\lambda)=a\times P2(\lambda)+b \quad (7)$$

The current spectral reflectivity R2(λ) is calculated by the following Equation (8). Note that the spectral reflectivity R2(λ) of the following Equation (8) is the spectral reflectivity Or(λ) of the above described Equation (1).

$$R2(\lambda)=(P2'(\lambda)-M1(\lambda))/(W2(\lambda)-M1(\lambda))\times W_r(\lambda) \quad (8)$$

In Equation (8), the calculation data P2'(λ) is a value obtained by an approximate calculation with respect to the measurement data P1 (λ) obtained by Equation (7). Further, W2(λ) denotes the current white reference measurement data that was measured after light amount correction with respect to the white reference. Therefore, the relation W1(λ)≈W2(λ) exists. Hence, with regard to a value calculated with Equation (8), the value is approximately equivalent to a value calculated with Equation (2), and thus the influence of stray light caused by the adherence of paper powder or the like to the protective glass 19 can be reduced.

Note that, in the foregoing description, in Equation (7) a linear function is applied to the arithmetic expression for calculating the calculation data P2'(λ) from which a stray light component was removed. However, the present invention is not limited thereto. For example, in a case where a plurality of measurements can be performed as a correction other than for the white reference plate 20 and a dark-colored (for example, black) measurement object, an equation may be used that is a first- or higher degree function.

Correction Processing for Measurement Data of Spectral Color Measurement Device

Figure 6A:
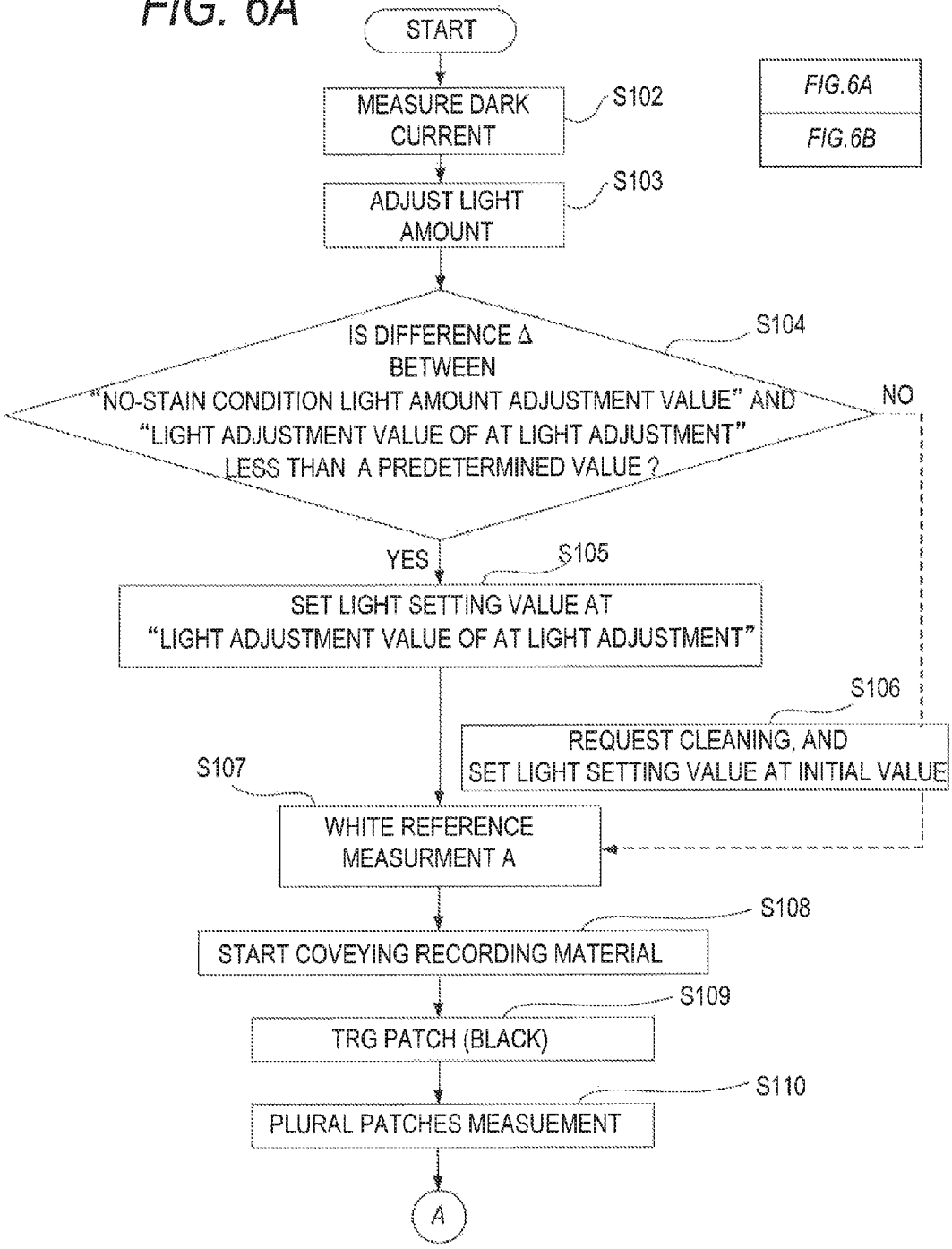
FIG. 6 is comprised of FIGS. 6A and 6B, showing flowcharts that illustrate color measurement processing according to Exemplary Embodiment 1.
Figure 6B:
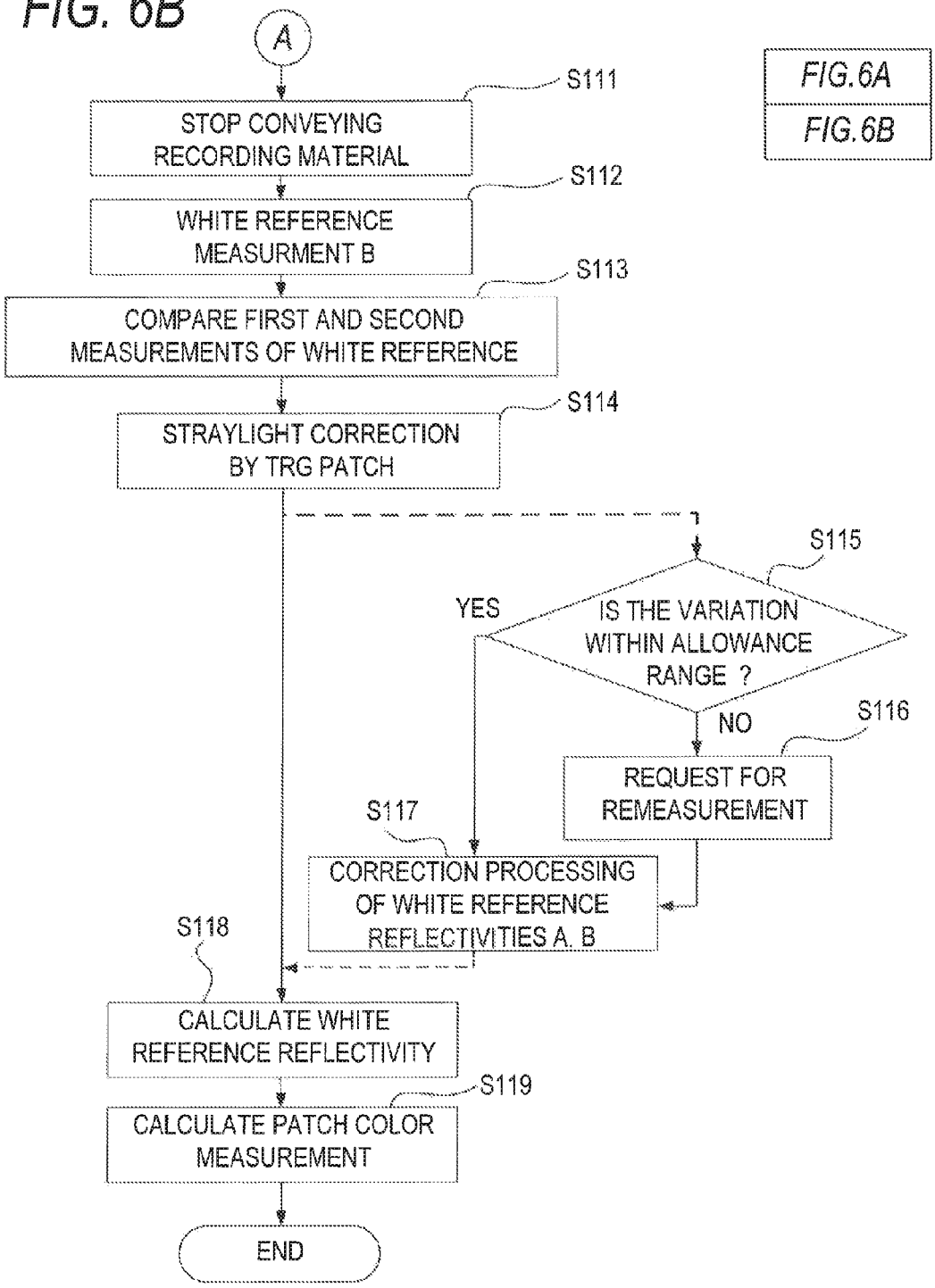

An example in which the above described calculation method is applied to data processing of the spectral color measurement device 10 inside an image forming apparatus is illustrated in FIGS. 6A and 6B. In step (hereunder, abbreviated to "S") 102, as sensor sensitivity correction for the spectral color measurement device 10, the control unit 55 performs measurement by means of the line sensor 11 of the spectral color measurement device 10 in a state in which the white light source 12 is off (light is turned off), that is, performs dark current measurement. The control unit 55 uses image data measured by the line sensor 11 in S102 (the measurement result obtained by the dark current measurement) as data for offset calculation.

In S103, the control unit 55 irradiates the light 15 from the white light source 12 onto the white reference plate 20, and adjusts the light amount of the white light source 12 (hereunder, referred to as "adjustment of the light source light amount"). The control unit 55 performs adjustment of the light source light amount, for example, by the following control. That is, the control unit 55 irradiates the light 15 from the white light source 12 onto the white reference plate 20, and acquires data with respect to the white reference plate 20 by means of the line sensor 11. Subsequently, the control unit 55 repeatedly measures the white reference plate 20 and controls the drive current of the white light source 12 so that a maximum brightness of the acquired data becomes a desired value. Note that, an adjustment value at the time of light amount adjustment that is obtained when the control unit 55 performs adjustment of the light source light amount in S103 is denoted by LED_ADJ1.

In S104, the control unit 55 compares the adjustment value (LED_ADJ1) when light amount adjustment was performed in S103 and a light amount adjustment value in a state in which there are no stains (described as "no-stain condition light amount adjustment value" in the figure). Here, the no-stain condition light amount adjustment value is denoted by LED_ADJ0. It is assumed that LED_ADJ0 is stored in advance in the memory unit 23 of the spectral color measurement device 10. The control unit 55, for example, calculates a difference value ΔLED_ADJ (=|LED_ADJ0-LED_ADJ1|) between the adjustment value (LED_ADJ1) at the time of the light amount adjustment performed in S103 and the no-stain condition light amount adjustment value (LED_ADJ0). The control unit 55 determines whether or not the calculated difference value ΔLED_ADJ is greater than a predetermined value. If the calculated difference value ΔLED_ADJ is less than or equal to the predetermined value, the control unit 55 determines that the state is one in which cleaning is not required (state is OK). On the other hand, if the calculated difference value ΔLED_ADJ is greater than the predetermined value (indicated as "N" in the figure), the control unit 55 determines that the state is one in which cleaning is required (state is not OK). If the control unit 55 determined in S104 that the calculated difference value ΔLED_ADJ (may also be referred to as "comparison result") is greater than the predetermined value (state is not OK), in S106 the control unit 55 outputs a request to clean the protective glass 19. Note that, the control unit 55, for example, causes cleaning of the surface of the protective glass 19 to be executed or causes cleaning of the white reference plate 20 to be executed. The control unit 55 also sets the initial value (=LED_ADJ0) as the light amount setting value. Note that the processing in S106 is not essential processing, and a configuration may also be adopted in which the processing in S106 is not performed. Therefore, the flow to the processing in S106 and S107 from the determination in S104 is indicated with a broken line in FIGS. 6A and 6B. In the case of omitting the processing in S106, the flow advances from the processing in S103 to the processing in S105.

If the control unit 55 determines in S104 that the calculated difference value ΔLED_ADJ is equal to or less than the predetermined value (state is OK), in S105 the control unit 55 sets the light amount adjustment value (=LED_ADJ1) at the time that light amount adjustment was performed in S103 as the light amount setting value. In S107, the control unit 55 performs a white reference measurement A that is a first measurement by means of the spectral color measurement device 10. That is, the control unit 55 uses the spectral color measurement device 10 to irradiate the light 15 with the light amount setting value that was set in S105 or S106 from the white light source 12 onto the white reference plate 20 and measure the reflected light. The measurement result for the white reference measurement A that the control unit 55 performed using the spectral color measurement device 10 is a value measured in a state in which the light amount adjustment value is LED_ADJ1 (LED_ADJ0 if the flow branched to S106), and this value is taken as W2_A(λ). In S108, the control unit 55 starts conveyance of the recording material P. The patch image T that includes a trigger patch that serves as a criterion for starting measurement is formed on the recording material P as illustrated in FIG. 2A. According to the present exemplary embodiment, black that is the color having the largest color difference with respect to the color of the recording material P is used as the trigger patch of a predetermined lightness. In S109, the control unit 55 uses the spectral color measurement device 10 to detect the arrival of the trigger patch (described as "TRG patch (black)" in the figure) on the recording material P and measure the trigger patch. Note that, in S109, a measurement value of the trigger patch that the control unit 55 obtains by performing color measurement by means of the spectral color measurement device 10 is the above described S2(λ). In S110, the control unit 55 also performs measurement of a plurality of patches other than the trigger patch of the patch image T formed on the recording material P that continues to be conveyed. Note that, a measurement value of a patch other than the trigger patch for which the control unit 55 performed color measurement by means of the spectral color measurement device 10 in S110 is the above described P2(λ).

Thereafter, when the recording material P is conveyed as far as a position at which the recording material P is separated from the color measurement position of the spectral color measurement device 10, and the recording material P on which the patch image T is formed is discharged to the sheet-discharge tray 52, in S111, the control unit 55 ends conveyance of the recording material P for color measurement processing by the spectral color measurement device 10. At this timing, since the recording material P is separated from the color measurement position of the spectral color measurement device 10, the state is one in which it is possible to again measure the white reference plate 20 by means of the spectral color measurement device 10. In S112, the control unit 55 performs measurement of the white reference plate 20 again (referred to as "white reference measurement B" that is a second measurement). Note that, a measurement result for the white reference measurement B that the control unit 55 obtains by performing measurement by means of the spectral color measurement device 10 in S112 is a value that is measured in a state in which the light amount adjustment value is LED_ADJ1 (LED_ADJ0 in a case where the processing flow branched to S106), and this value is taken as W2_B(λ). The measurement of the white reference plate 20 again by the spectral color measurement device 10 can be performed at a timing after the trailing end of the recording material P has passed through the spectral color measurement device 10.

By performing measurement twice by means of the spectral color measurement device 10 in S107 and S112, the control unit 55 can compare the stain condition of the white reference plate 20 before and after conveyance of the recording material P. In S113, the control unit 55 compares the measurement result W2_A(λ) of the white reference measurement A performed in S107 and the measurement result W2_B(λ) of the white reference measurement B performed in S112, and determines a value W2(λ) of the white reference measurement based on the comparison result. For example, the following processing is available as the processing that the control unit 55 executes in S113. The control unit 55 compares the respective measurement values for each pixel (for each wavelength) of the white reference measurement A and the white reference measurement B. If the control unit 55 determines that a difference value between the white reference measurement A and the white reference measurement B is equal to or less than a predetermined value, the control unit 55 determines that there is almost no change in the stain condition as a result of passage of the recording material P through the spectral color measurement device 10, and decides the value of W2(λ) based on the value of either one of W2_A(λ) and W2_B(λ).

If the control unit 55 determines that the difference value between the white reference measurement A and the white reference measurement B is larger than the predetermined value, the control unit 55 further makes a distinction between different cases in the following manner. If the control unit 55 determines that the difference value is greater than the predetermined value and also that the measurement value W2_B(λ) of the white reference measurement B has become darker than the measurement value W2_A(λ) of the white reference measurement A, the control unit 55 determines that the paper powder or the like 200 on the protective glass 19 was removed by conveyance of the recording material P. The control unit 55 then decides the value of W2(λ) based on the measurement value W2_B(λ) of the white reference measurement B. On the other hand, if the control unit 55 determines that the difference value is greater than the predetermined value and also that the measurement value W2_A(λ) of the white reference measurement A is darker than the measurement value W2_B(λ) of the white reference measurement B, the control unit 55 makes the following determination. That is, the control unit 55 determines that paper powder or the like adhered to the protective glass 19 as a result of conveyance of the recording material P or that the light amount of the white light source 12 changed. The control unit 55 then performs, for example, linear interpolation with respect to the measurement values of the white reference measurement A and the white reference measurement B, and decides the value of W2(λ) based on the linearly interpolated value.

Note that, as the processing the control unit 55 executes for comparing the white reference measurements A and B before and after conveyance of the recording material P, an average value of W2_A(λ) and W2_B(λ) may be determined or a value may be determined using other processing. In addition, a configuration may also be adopted in which only either one of the white reference measurement A and the white reference measurement B is performed. Further, for example, the control unit 55 may decide whether to perform only either one of or both of the white reference measurement A and the white reference measurement B based on the conveying speed of the recording material P. Thus, various methods are conceivable with respect to conducting the white reference measurement and the way in which to use a measurement result of the white reference measurement.

In S114, the control unit 55 performs correction of stray light using the trigger patch as described in the aforementioned Equation (3) by means of the control calculation unit 22 of the spectral color measurement device 10. More specifically, the control calculation unit 22 calculates the correction coefficients a and b from the above described Equation (5) and Equation (6) based on the values of W1(λ), W2(λ), S1(λ) and S2(λ). In this case, it is assumed that W1(λ) and S1(λ) are stored in advance in the memory unit 23 of the spectral color measurement device 10. Note that, although the control unit 55 proceeds to the processing in S118 after the processing in S114, the control unit 55 can also execute processing such as in, for example, S115 to S117 after the processing in S114.

That is, in S115 the control unit 55 determines whether or not the level of stray light caused by adherence of paper powder or the like (hereunder, referred to as "stray light level") is within a predetermined range based on the measurement value S2(λ) of the trigger patch that was measured in S109. In this case, the term "predetermined range" is a range in which correction of stray light can be performed. For example, the control unit 55 calculates the difference between the measurement values S2 (λ) and S1 (λ) of the trigger patch as the stray light level, and determines whether or not the calculated difference is within the predetermined range. If the control unit 55 determines in S115 that the stray light level is within the predetermined range (the variation level is OK), the control unit 55 proceeds to the processing in S117, while if the control unit 55 determines in S115 that the stray light level is not within the predetermined range (the variation level is not OK), the control unit 55 proceeds to the processing in S116. In S116 the control unit 55 determines that the stray light level is not within a range in which correction of the stray light can be performed and, for example, sets a warning flag to the effect of requesting remeasurement, and then proceeds to the processing in S117. In S117, for example, by performing similar processing as the processing described in S113, the control unit 55 corrects the values for the white reference measurement A and the white reference measurement B based on the variation in the stray light level. As the processing performed in S117, for example, based on the difference between the measurement values S2 (λ) and S1 (λ) of the trigger patch, the control unit 55 determines a value obtained by deducting the influence caused by the stray light from the value W2(λ) that was determined in S113 as the value of W2(λ). Note that, since the processing in S115 to S117 can be omitted, in FIG. 6A and FIG. 6B the flow between S114 and S118 is indicated with a broken line.

In S118, the control unit 55 calculates a white reference reflectivity W2_r(λ) using a and b that were calculated in S114, by means of the control calculation unit 22 of the spectral color measurement device 10. The white reference reflectivity W2_r(λ) calculated in S118 is a value that is calculated in a state in which the influence of the stray light has been removed. The white reference reflectivity W2_r(λ) calculated in S118 is calculated as follows. First, based on Equation (4), $$W1(\lambda)=a\times W2(\lambda)+b$$

By substituting P2' (λ) with W2' (λ) and substituting P2(λ) with W2(λ) in Equation (7), the following equation is obtained:

$$W2'(\lambda)=a\times W2(\lambda)+b$$

Here, when the value W2'(λ) from which stray light was removed is used as W2(λ) of the denominator in Equation (8), the resulting equation is:

$$\begin{aligned} W2_r(\lambda)&=(W2'(\lambda)-M1(\lambda))/(W2'(\lambda)-M1(\lambda))\times W_r(\lambda)\\ &=W_r(\lambda)\end{aligned}$$

Further, in S119, using the control calculation unit 22 of the spectral color measurement device 10, the control unit 55 performs a color measurement calculation with respect to the data P2(λ) of the patches of the respective gradations of the patch image T measured in S110 using the following equation:

$$R2(\lambda)=(P2'(\lambda)-M1(\lambda))/(W2'(\lambda)-M1(\lambda))\times W_r(\lambda) \quad (9)$$

The value W2' (λ) from which the influence stray light has been removed is used in Equation (9) also.

Note that, based on the result obtained by detecting the patch image T, the control unit 55 performs feedback to a calibration table or the like for correcting the exposure amount of the image forming section or the process conditions or density-gradation characteristics. The control unit 55 then performs control with respect to the density or chromaticity of a final output image that is formed on the recording material P. After performing color measurement calculations for all patches of the patch image T, the control unit 55 ends the color measurement operation. The foregoing describes the flow of a series of processing operations. Note that, although the color measurement calculations are performed collectively in S119 according to the present exemplary embodiment, the timing of the calculations is not limited thereto. For example, stray light correction may be performed immediately after measuring the trigger patch, and color measurement calculations may be performed sequentially for each patch measurement. This similarly applies to the embodiments described hereunder.

The spectral color measurement device 10 having the above described configuration and adopting the present sequence was installed in an image forming apparatus and read a patch image T that was output with the image forming apparatus. When the accuracy of the color measurement calculation was checked, it was found that a high level of color measurement accuracy could be obtained. According to the correction processing of the present exemplary embodiment, it is possible to lessen the influence on the color measurement accuracy of stains on the protective glass 19 that affect the color measurement accuracy which are produced by paper powder that is generated accompanying image formation and dust that enters from the external environment, and consequently a stable color measurement accuracy can be maintained. Further, since the spectral color measurement device 10 that has a simple configuration can also maintain a high level of color measurement accuracy with respect to stains such as paper powder, it is easy to mount the spectral color measurement device 10 to an image forming apparatus. In addition, by reading the output patch image T by means of the spectral color measurement device 10 that is installed inside the image forming apparatus and feeding back the obtained results with respect to the image forming conditions, an output object having favorable color stability can be obtained. Thus, according to the present exemplary embodiment, the color measurement accuracy of a color measurement device can be improved.

Exemplary Embodiment 2

Figure 7:
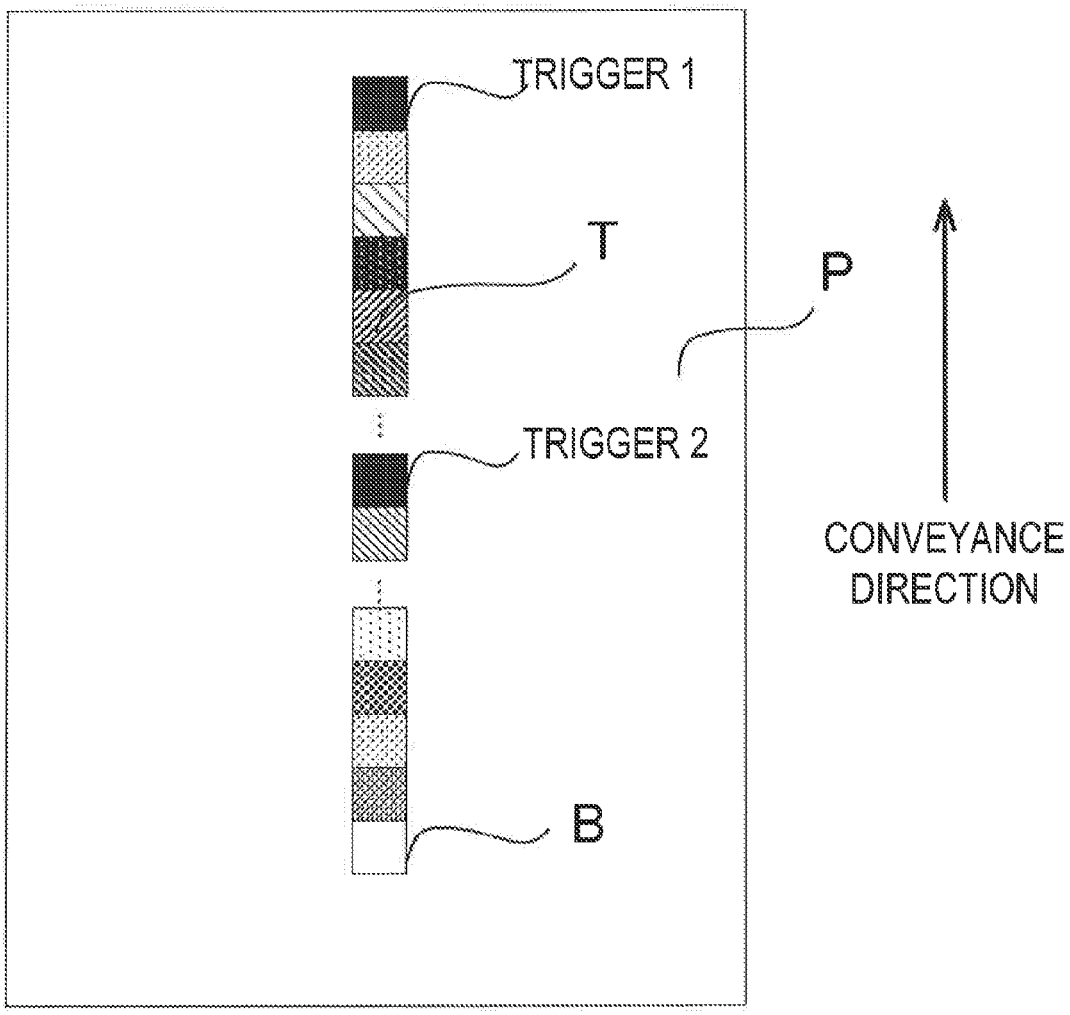
FIG. 7 is a view illustrating a patch image for color measurement according to Exemplary Embodiment 2.

Correction Processing of Measurement Data of Spectral Color Measurement Device A patch image T illustrated in FIG. 7 will now be described with respect to Exemplary Embodiment 2. FIG. 7 illustrates a patch image T for color measurement of the recording material P with respect to which a measurement is performed by the spectral color measurement device 10 in the present exemplary embodiment. Unlike FIG. 2A, two trigger patches (trigger 1 and trigger 2) are formed in patch image T illustrated in the FIG. 7. These trigger patches have a combination of both the stray light correction function and the color measurement timing function described in Exemplary Embodiment 1. According to the present exemplary embodiment, similarly to Exemplary Embodiment 1, black that has the largest color difference with respect to the recording material P is used for the trigger patches. Note that, in a case where the recording material P is elongated, although two or more trigger patches may be provided, the present exemplary embodiment describes an example in which two trigger patches are provided using FIG. 8A and FIG. 8B.

Figure 8A:
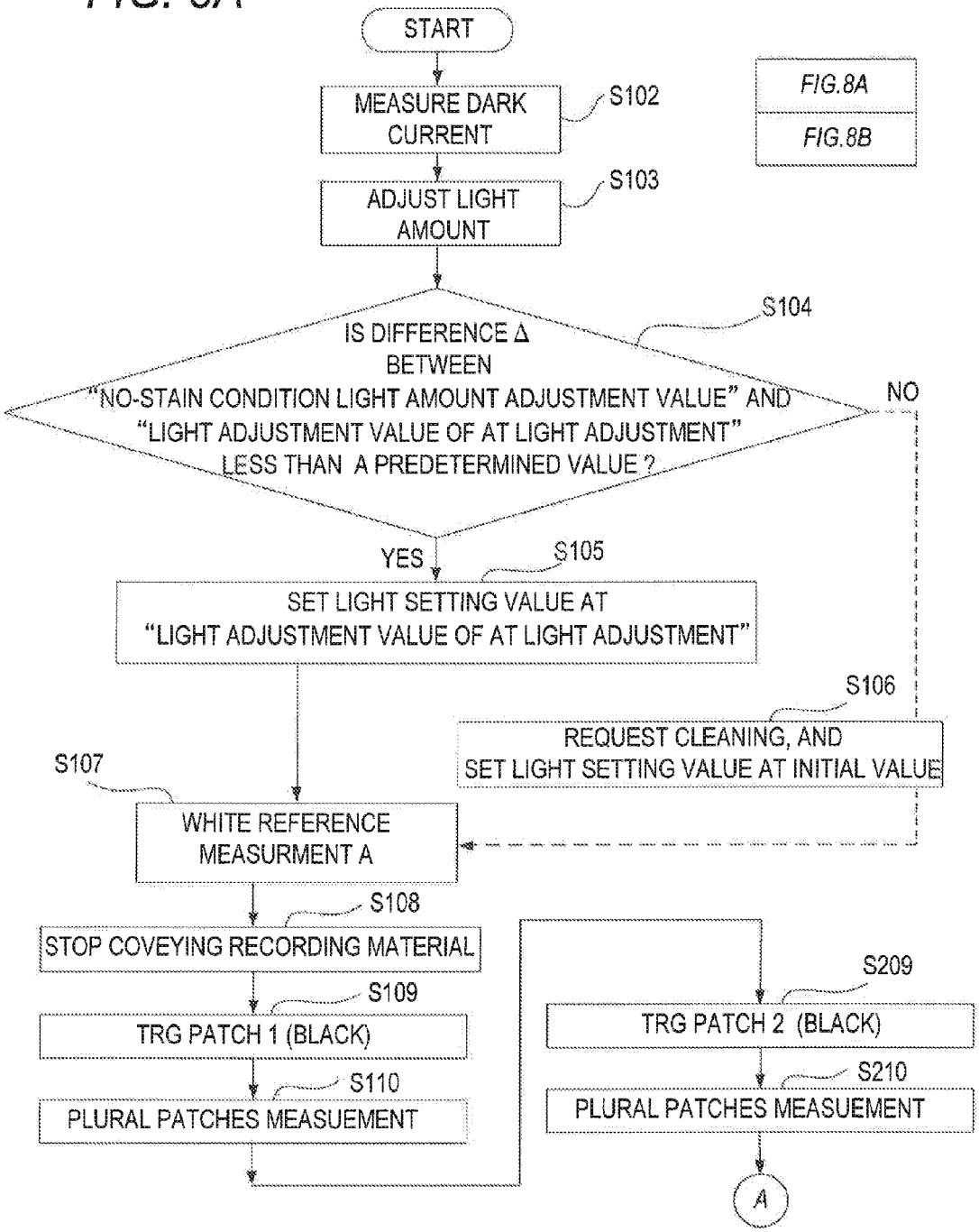
FIG. 8 is comprised of FIGS. 8A and 8B, showing flowcharts illustrating color measurement processing according to Exemplary Embodiment 2.
Figure 8B:
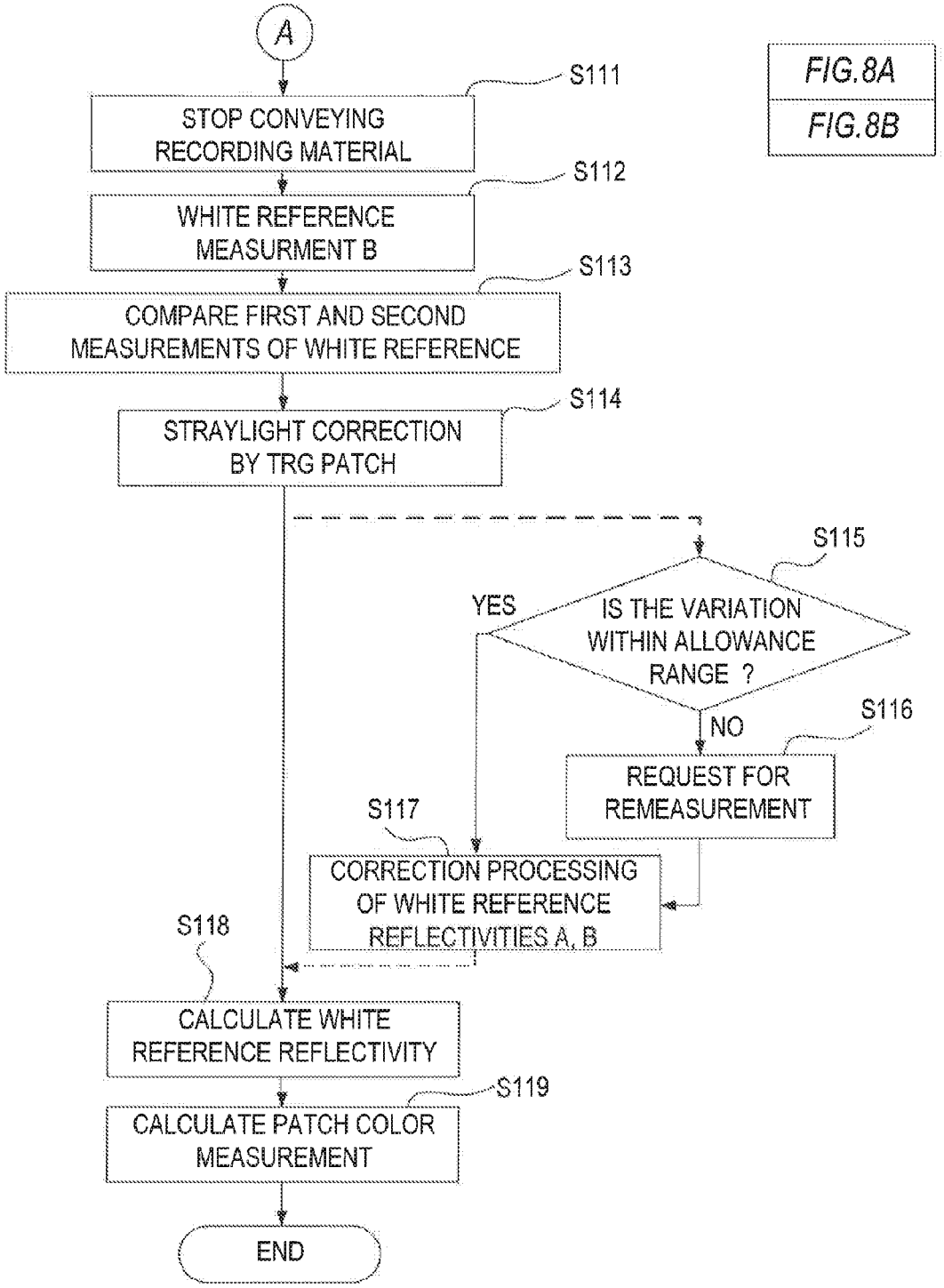

In the flowcharts illustrated in FIG. 8A and FIG. 8B, processing that is the same as processing in the flowcharts illustrated in FIG. 6A and FIG. 6B is denoted by the same step number, and a description of such processing is omitted hereunder. In the present exemplary embodiment, because there are two trigger patches, a trigger patch on the recording material P that the control unit 55 detects by means of the spectral color measurement device 10 in S109 of FIGS. 8A and 8B is the first trigger patch (trigger 1; described as "TRG patch 1

(black)" in the drawings). The result of the measurement by the spectral color measurement device 10 that the control unit 55 obtains in S109 is taken as S2_1(λ).

In S209, the control unit 55 detects the trigger patch 2 formed on the same recording material P, by means of the spectral color measurement device 10. The result of the measurement by means of the spectral color measurement device 10 that the control unit 55 obtains in S209 is taken as S2_2(λ). In S210, the control unit 55 performs measurement of other patches formed on the recording material P that continues to be conveyed.

In S114, the control unit 55 performs correction of stray light produced by the paper powder or the like 200 that adheres to the protective glass 19, as described using Equation (3) of Exemplary Embodiment 1. In a case where the control unit 55 performs stray light correction, the correction may be performed using a difference (S2_2(λ)−S2_1(λ)) between the trigger patch 1 and the trigger patch 2, or average processing ((S2_2(λ)+S2_1(λ))/2) may be performed. Note that, in a case where the patch image T includes a plurality of trigger patches, average processing ((S2_1+S2_2+ . . . +S2_n)/n) of the measurement results of the plurality of trigger patches (n trigger patches, where n represents a positive integer) may be performed.

The foregoing describes the flow of a series of processing operations. The spectral color measurement device 10 having the above described configuration and adopting the present sequence was installed in an image forming apparatus, and read the patch image T of the present exemplary embodiment that was output with the image forming apparatus. When the accuracy of the color measurement calculation was checked, it was found that, similarly to Exemplary Embodiment 1, a high level of color measurement accuracy could be obtained. Thus, according to the present exemplary embodiment, the color measurement accuracy of a color measurement device can be improved.

Exemplary Embodiment 3

In Exemplary Embodiments 1 and 2, the trigger patch and the white reference plate 20 are measured, and stray light correction processing is performed on the basis that stains are adhered to either one of the protective glass 19 and the white reference plate 20. According to Exemplary Embodiment 3, a configuration is adopted that measures a patch that is bright in comparison to the trigger patch, and if it is determined based on the result of measuring the white reference plate 20 and the result of measuring the bright patch that stains are present on the white reference plate 20, correction is performed with respect to the stains on the white reference plate 20.

Figure 9A:
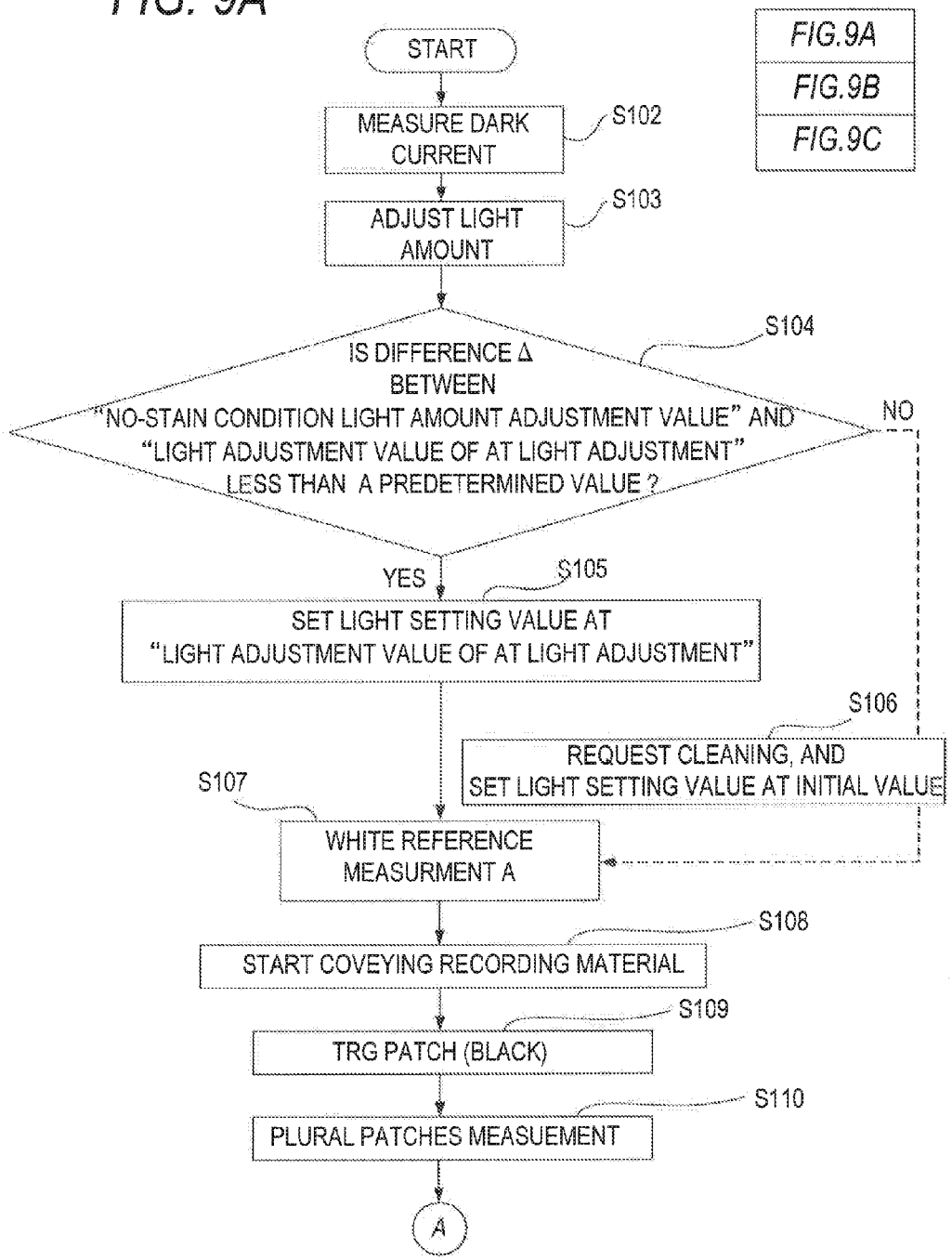
FIG. 9 is comprised of FIGS. 9A, 9B and 9C, showing flowcharts illustrating color measurement processing according to Exemplary Embodiment 3.
Figure 9B:
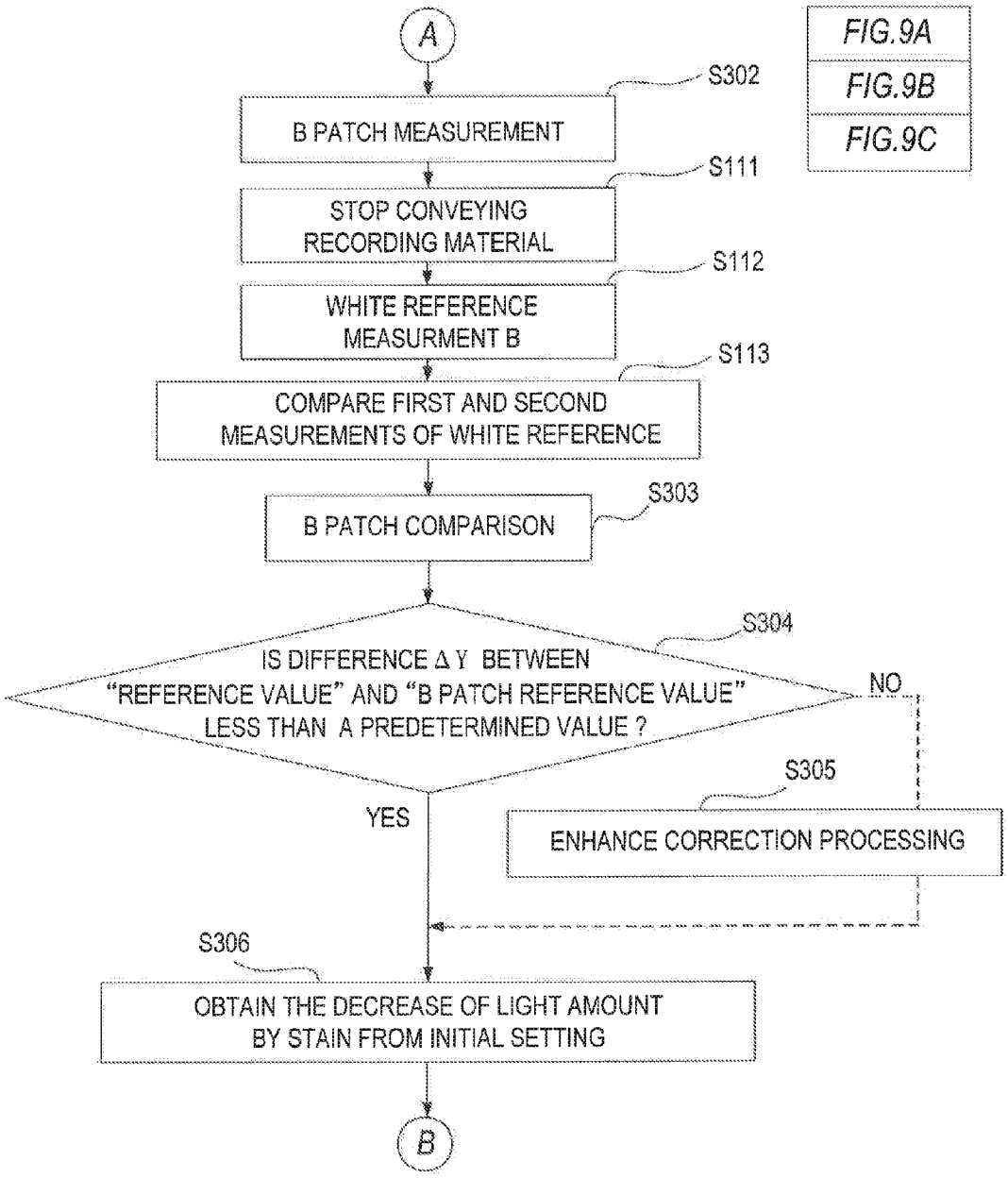
Figure 9C:
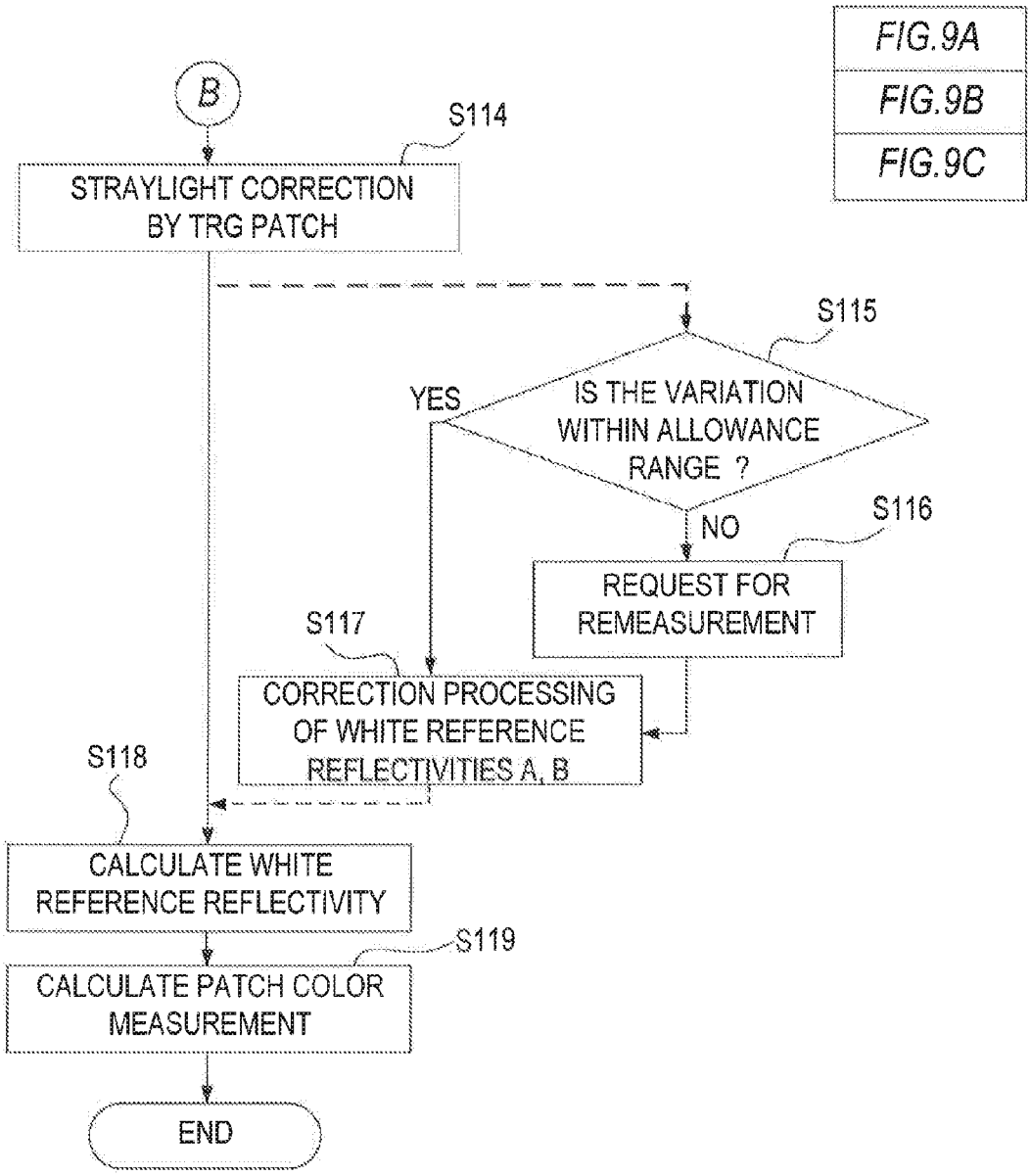

Correction Processing for Measurement Data of Spectral Color Measurement Device The present exemplary embodiment will now be described using FIG. 9A, FIG. 9B and FIG. 9C. Note that processing that is the same as processing described in Exemplary Embodiment 1 is denoted by the same step number, and a description of such processing is omitted hereunder. As the patch image T that is used for the processing illustrated in FIGS. 9A to 9C, a patch having a high degree of lightness in comparison to a trigger patch of a predetermined lightness, that is, a bright patch, is disposed as denoted by reference character B in FIG. 2A and FIG. 7. More specifically, a patch (hereunder, referred to as "B patch") of a single color such as yellow is used for a color image forming apparatus. Note that although a plurality of B patches may be provided on the recording material P, according to the present exemplary embodiment an example in which a single B patch is provided is described using FIG. 9A, FIG. 9B and FIG. 9C.

In S302, the control unit 55 performs measurement of the B patch of the patch image T on the recording material P by means of the spectral color measurement device 10. Note that although measurement of the B patch is executed after the processing in S109 and S110 in FIGS. 9A to 9C, measurement of the B patch may be performed in S110. In S303, the control unit 55 performs a comparison with the B patch measured in S302. The control unit 55 performs a comparison of stain conditions using the measurement result of the B patch measured in S302 and, for example, either one of a reference value or an initial color measurement result of a patch of the image forming apparatus (it is assumed that both are for the same color as the B patch). Here, it is assumed that, for example, the reference value or the initial color measurement result of the patch of the image forming apparatus is for yellow, and the value thereof is taken as Y1(λ). It is assumed that Y1(λ) is stored in advance in the memory unit 23 of the spectral color measurement device 10. Further, the measured value of the B patch is taken as Y2(λ). Next, the control unit 55, for example, calculates a difference value ΔY between the measurement value Y2(λ) of the B patch measured in S302 and the reference value or the like Y1(λ), and determines whether or not the calculated difference value ΔY is greater than a predetermined value. If the calculated difference value ΔY is less than or equal to the predetermined value, the control unit 55 determines that it is not necessary to perform correction processing that is required when stains have increased (hereunder, referred to as "stain increase correction processing") (i.e. the state is OK). On the other hand, if the calculated difference value ΔY is greater than the predetermined value, the control unit 55 determines that the state is one in which the stain increase correction processing is necessary (i.e. the state is not OK).

If the control unit 55 determines in S304 that stain increase correction processing is necessary based on the result of the comparison with the B patch, the control unit 55 performs the stain increase correction processing in S305. In S305, the control unit 55 attempts to optimize the white reference profile that is mainly used in a color measurement calculation. Here, the relations in Equation (2) and the like (for example, Y1(λ)=c×Y2(λ)+d; where c and d are coefficients) also hold with respect to the B patch. The control unit 55 reflects variations in the measurement results that are caused by stains that are determined based on the measurement result of the B patch in the measurement value W2(λ) for the white reference. For example, based on the difference between the measurement value Y2 (λ) of the B patch and Y1(λ), the control unit 55 determines a value obtained by deducting the influence of stains from the value W2(λ) that was determined in S113 as the value for W2(λ).

In S306, the control unit 55 extracts the amount of decrease in the light amount caused by stains from when the white reference plate 20 was initially installed. Here, the reflectivity is high in a state in which the white reference plate 20 is not stained, and the reflectivity decreases when the white reference plate 20 becomes stained. The control unit 55 extracts the amount of decrease in the light amount based on a decrease in the reflectivity caused by stains on the white reference plate 20. Note that when performing correction processing with respect to measurement data of the patches of respective gradations of the patch image T, the control unit 55 uses data for the amount of decrease in the light amount that was extracted. More specifically, since stains such as paper powder have different spectral intensity levels for each wavelength, the data for the amount of decrease in the light amount that was extracted is used for calculating as a correction coefficient for each spectral reflectivity of the respective patches that are measured.

The spectral color measurement device 10 that has the aforementioned configuration and performs the above described correction processing was installed in an image forming apparatus and read the patch image T that was output by the image forming apparatus, and the accuracy of the color measurement calculation was checked. The result showed that a high level of color measurement accuracy could be obtained even in a case where stray light caused by stains on the protective glass 19 increased and a decrease in the main light occurred or in a case where the white reference plate 20 is affected by stains. Thus, according to the present exemplary embodiment, the color measurement accuracy of a color measurement device can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-129813, filed Jun. 20, 2013, which is hereby incorporated by reference herein in its entirety.

What is claimed is:

1. An image forming apparatus comprising:

an image forming unit that forms a patch image on a recording material, the patch image including patches of a plurality of gradations;

a fixing unit that fixes the patch image formed by the image forming unit;

a measurement unit that irradiates light onto the patch image fixed by the fixing unit, and measures reflected light from the patch image;

a reference plate provided to oppose to the measurement unit; and a control unit that controls a density or a chromaticity of an image based on a result obtained by measuring the patch image and a result obtained by measuring the reference plate by the measurement unit, wherein the control unit corrects information for controlling a density or a chromaticity of an image based on a result obtained by measuring a patch of a predetermined lightness and a result obtained by measuring the reference plate by the measurement unit, and wherein the control unit performs a first measurement of the reference plate by the measurement unit before a recording material reaches the measurement unit, and performs a second measurement of the reference plate by the measurement unit after the recording material passes through the measurement unit.

2. An image forming apparatus according to claim 1, wherein the correction of information for controlling a density or a chromaticity of an image includes correction of stray light of the measurement unit.

3. An image forming apparatus according to claim 1, wherein the patch of a predetermined lightness includes a black patch.

4. An image forming apparatus according to claim 3, wherein the black patch is formed at a top of the patch image in a conveyance direction of a recording material.

5. An image forming apparatus according to claim 3, wherein the patch image has a plurality of the black patches, at least one of the plurality of black patches formed at a top of the patch image in a conveyance direction of a recording material; and wherein the control unit corrects the information for controlling a density or a chromaticity of an image based on results of measurement of a plurality of the black patches by the measurement unit.

6. An image forming apparatus according to claim 3, wherein the control unit corrects a result obtained by measuring the reference plate by the measurement unit based on a result obtained by measuring the black patch by the measurement unit.

7. An image forming apparatus according to claim 1, wherein the control unit calculates a result obtained by measuring the reference plate based on a measurement result of the first measurement and a measurement result of the second measurement.

8. An image forming apparatus according to claim 1, wherein the reference plate is white.

9. An image forming apparatus according to claim 1, wherein the patch image includes a patch having a high lightness relative to the patch of a predetermined lightness; and the control unit corrects a result obtained by measuring the reference plate by the measurement unit based on a result obtained by measuring the patch having a high lightness by the measurement unit.

10. An image forming apparatus according to claim 9, wherein the patch having a high lightness is a yellow patch.

11. An image forming apparatus according to claim 1, wherein the measurement unit includes a white light source.

12. An image forming apparatus according to claim 11, wherein the white light source irradiates light in a wavelength region from 400 nm to 700 nm.

13. An image forming apparatus according to claim 1, wherein the measurement unit includes:

a spectral unit that disperses reflected light from the patch image; and a line sensor that receives light that is dispersed by the spectral unit.

14. An image forming apparatus according to claim 13, wherein a pixel of the line sensor is associated with a wavelength of the dispersed light.

* * * * *